US012324553B2

(12) United States Patent
Kim et al.

(10) Patent No.: US 12,324,553 B2
(45) Date of Patent: Jun. 10, 2025

(54) DISHWASHER

(71) Applicant: LG Electronics Inc., Seoul (KR)

(72) Inventors: Jinhong Kim, Seoul (KR); Youmin Lee, Seoul (KR); Jindong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/087,922

(22) Filed: Dec. 23, 2022

(65) Prior Publication Data

US 2023/0200620 A1 Jun. 29, 2023

(30) Foreign Application Priority Data

Dec. 24, 2021 (KR) ..... 10-2021-0187689
Jul. 22, 2022 (KR) ..... 10-2022-0090742
Jul. 22, 2022 (KR) ..... 10-2022-0090743

(51) Int. Cl.
*A47L 15/42* (2006.01)

(52) U.S. Cl.
CPC ..... *A47L 15/4282* (2013.01); *A47L 15/4217* (2013.01); *A47L 15/4223* (2013.01)

(58) Field of Classification Search
None
See application file for complete search history.

(56) References Cited

U.S. PATENT DOCUMENTS 9,010,345 B2 * 4/2015 Mitchell ..... A47L 15/4282 134/198
2014/0069469 A1 3/2014 Choi et al.

FOREIGN PATENT DOCUMENTS

| | | |
|---|---|---|
| CN | 1061522 | 6/1992 |
| CN | 109589068 | 4/2019 |
| EP | 3563751 | 11/2019 |

OTHER PUBLICATIONS

Hansen Plastics article, https://www.hansenplastics.com/how-is-plastic-injection-molding-used-in-household-appliances, Apr. 2022 (Year: 2022).*
Extended European Search Report in European Appln. No. 22215411.4, mailed on May 24, 2023, 8 pages.

* cited by examiner

*Primary Examiner* — Rita P Adhlakha
(74) *Attorney, Agent, or Firm* — Fish & Richardson P.C.

(57) ABSTRACT

A dishwasher uses washing water containing microbubbles. The dishwasher includes a flow path forming rib that defines a washing water flow path inside an upper body and a lower body of a spray arm. The dishwasher further includes a fusion rib for fusion coupling the upper body and the lower body to effectively secure a flow path structure and simplify a fastening structure.

20 Claims, 33 Drawing Sheets

DISHWASHER

CROSS-REFERENCE TO RELATED APPLICATIONS

This application claims the benefit of Korean Patent Application No. 10-2021-0187689, filed on Dec. 24, 2021, Korean Patent Application No. 10-2022-0090742, filed on Jul. 22, 2022, and Korean Patent Application No. 10-2022-0090743, filed on Jul. 22, 2022. The disclosures of the prior applications are incorporated by reference in their entirety.

BACKGROUND OF INVENTION

Field of the Invention

The present disclosure relates to a dishwasher, and more particularly, to a dishwasher capable of improve washing performance by using washing water containing microbubbles, and integrally forming a flow path forming rib for forming a washing water flow path inside an upper body and a lower body configuring a spray arm and a fusion rib for fusion coupling the upper body and the lower body to effectively secures a flow path structure and simplify a fastening structure.

Related Art

Dishwashers are devices that spray washing water such as water to an object to be washed such as a cooking vessel, a cooking tool and the like, stored in the dishwasher, to wash the object to be washed. The washing water used for a wash may include detergent.

It is common for the dishwasher to include a wash tub forming a wash space, a storage portion disposed in the wash tub and configured to accommodate an object to be washed, a spray arm configured to spray water to the storage portion, and a sump configured to store water and to supply washing water to the spray arm.

The dishwashers may help users to reduce time and efforts spent on washing the dishes after a meal, thereby improving user convenience.

Recently, technologies for improving washing performance of dishwashers have been developed.

In this regard, Korean Patent Application Publication No. 10-2018-0015929 (Related Art 001) discloses a dishwasher including a microbubble generator for generating microbubbles in washing water.

The dishwasher disclosed in Related Art 001 is configured to have a structure in which a microbubble generator is installed using an accommodation space or machine room formed at a lower side of a tub.

However, the microbubble generator structure provided in the dishwasher of Related Art 1 has a structure in which a washing pump is connected to the tub by utilizing a lower space of the tub. Accordingly, the channel structure is very complicated, and the number of components related to flow path connection and the cost of materials increase.

In addition, the dishwasher of Related Art 001 has an issue in that space utilization for an accommodation space in which a separate space for installing the microbubble generator is formed in a lower portion of the tub is deteriorated.

RELATED ART DOCUMENTS

Patent Documents (Patent Document 001) Korean Patent Application Publication No. 10-2018-0015929

(Patent Document 002) Korean Patent Application Publication No. 10-2017-0139801

SUMMARY

The present disclosure has been devised to address an issue associated with the related art. A first aspect of the present disclosure is to provide a dishwasher with improved washing performance by using washing water containing microbubbles.

In addition, a second aspect of the present disclosure is to provide a dishwasher capable of simplifying a structure and significantly reducing material costs by minimizing changes to a tub by forming a bubble generation flow path inside a spray arm.

In addition, a third aspect of the present disclosure is to provide a dishwasher capable of effectively securing a flow path structure and simplifying a fastening structure by integrally forming a flow path forming rib for forming a washing water flow path inside an upper body and a lower body configuring a spray arm and a fusion rib for fusion coupling the upper body and the lower body.

In addition, a fourth aspect of the present disclosure is to provide a dishwasher capable of reinforcing coupling force between the upper body and the lower body by configuring the flow path forming rib to be fused in at least a partial section when the upper body and the lower body are fastened.

In addition, a fourth aspect of the present disclosure is to provide a dishwasher capable of effectively preventing damage or breakage of the spray arm by using a deco cover made of metal to protect an upper surface of the spray arm provided in a hollow shape to form the washing water flow path therein.

In addition, a sixth aspect of the present disclosure is to provide a dishwasher capable of effectively preventing user injury by integrally forming a fastening tab for coupling the deco cover to the spray arm with the deco cover, and forming a storage portion for storing the bent fastening tab at a lower portion of the spray arm.

Aspects of the present disclosure are not limited to the above-mentioned aspects, and other aspects and advantages of the present disclosure, which are not mentioned, will be understood through the following description, and will become apparent from the embodiments of the present disclosure. In addition, it will be understood that the aspects and the advantages of the present disclosure can be realized by the means recited in claims and a combination thereof.

A dishwasher according to an embodiment of the present disclosure includes: a tub forming a washing space; a sump disposed at a lower side of the tub and storing washing water; and a spray arm discharging the washing water supplied from the sump into the washing space, wherein the spray arm includes a main body portion having a first flow path through which the washing water flows formed therein and discharging the washing water having passed through the first flow path into the washing space, and wherein the first flow path includes a connection flow path through which some of the washing water introduced through an opening formed in the main body portion is supplied; a buffer flow path fluidly connected to the connection flow path and having a flow path cross-sectional area larger than that of the connection flow path; an air suction flow path fluidly connected to the buffer flow path and suctioning air from a suction hole communicating with the washing space; and a discharge flow path fluidly connected to the air suction flow path and having a discharge hole discharging the washing water having passed through the air suction flow path toward the washing space.

In addition, the buffer flow path is formed with an inlet through which the washing water is supplied from the connection flow path and an outlet through which the washing water present inside the buffer flow path is supplied to the air suction flow path, and a center of the inlet may be disposed not to be positioned on the same line as a center of the outlet.

In addition, the center of the inlet may be formed above the center of the outlet in vertical direction.

In addition, an inner protrusion protruding toward the outlet to shift the center of the outlet may be disposed inside the spray arm.

In addition, the buffer flow path is formed with an inlet through which the washing water is introduced from the connection flow path and an outlet through which the introduced washing water is discharged toward the air suction flow path, and a cross-sectional area of the inlet and a cross-sectional area of the outlet may be formed to have different sizes.

In addition, the buffer flow path may include: an expansion portion disposed subsequent to the connection flow path and expanding a cross-sectional area of a flow path while proceeding along a flow direction of the washing water; a retaining portion disposed subsequent to the expansion portion and retaining the cross-sectional area of the flow path while proceeding along the flow direction of the washing water; and a contraction portion disposed subsequent to the retaining portion and contracting the cross-sectional area of the flow path while proceeding along the flow direction of the washing water.

In addition, the first flow path further includes an air flow passage for supplying air introduced from the suction hole to the air suction flow path, wherein the air flow passage may include at least one bending portion in which a flow direction of a flow path is changed.

In addition, the air flow passage may be connected to the air suction flow path at a position closer to the discharge flow path than the buffer flow path.

In addition, the suction hole may be formed to penetrate a lower surface of the main body portion.

The spray arm further includes a bubble discharge portion disposed to penetrate the main body portion in a vertical direction and having a first discharge hole among the discharge holes, wherein the bubble discharge portion may be formed separately from the main body portion and coupled to the main body portion.

In addition, the bubble discharge portion may be coupled to the main body portion by an insert injection molding method.

In addition, the bubble discharge portion includes: a wall portion disposed to penetrate the main body portion in a vertical direction and having the first discharge hole; and a flange portion integrally connected to an outer side surface of the wall portion and protruding in a direction away from the outer side surface of the wall portion, wherein when the insert injection is completed, the flange portion may be at least partially embedded in the main body portion.

In addition, the main body portion is provided with a lower end coupling hole into which a lower end of the wall portion is inserted, wherein a pair of second discharge holes among the discharge holes may be formed around the lower end coupling hole.

In addition, the main body portion includes: an upper body forming an upper portion divided along a vertical direction; and a lower body forming a lower portion divided along the vertical direction and coupled to a lower side of the upper body, wherein the upper body or the lower body may be provided with a flow path forming rib protruded in the vertical direction so as to form a left side surface and a right side surface of the first flow path.

A dishwasher according to an embodiment of the present disclosure includes: a tub forming a washing space; a sump disposed at a lower side of the tub and storing washing water flowing from the tub; a pump supplying the washing water stored in the sump to the washing space; and a spray arm discharging the washing water flowing from the tub into the washing space, wherein the spray arm may include a first blade in which a spray flow path through which the washing water flows therein is formed; a second blade in which a bubble generation flow path for generating microbubbles therein is formed; and a hub forming a supply flow path for supplying the washing water discharged from the pump to the spray flow path or the bubble generation flow path, wherein the first blade sprays the washing water into the washing space, and the second blade supplies the washing water containing the microbubbles to the washing space; and wherein the bubble generation flow path may include: a connection flow path connected to the supply flow path; a buffer flow path connected to the connection flow path and having a cross-sectional area of a flow path expanded and contracted in a direction away from the connection flow path; an air suction flow path connected to the buffer flow path and through which air is suctioned from a suction hole communicating with an outside of the spray arm; and a discharge flow path connected to the air suction flow path, having a cross-sectional area of the flow path expanded in a direction away from the air suction flow path, and discharging the flowing washing water to the outside of the spray arm through a discharge hole.

In addition, the second blade may have an additional flow path formed therein for spraying the washing water into the washing space.

In addition, the additional flow path may be disposed side by side with respect to a side surface of the buffer flow path.

In addition, a spray nozzle for spraying washing water flowing through the spray flow path into the washing space may be disposed on an upper surface of the first blade, and an additional spray nozzle for spraying the washing water flowing through the additional spray flow path into the washing space may be disposed on an upper surface of the second blade.

In addition, an interval at which the additional spray nozzle is spaced apart from a center of the main body portion may be formed smaller than an interval at which the spray nozzle is spaced apart from the center of the main body portion.

The dishwasher according to an embodiment of the present disclosure can perform washing using washing water containing microbubbles, thereby significantly improving washing performance.

In addition, the dishwasher according to an embodiment of the present disclosure can minimize changes to the tub by forming the bubble generation flow path inside the spray arm, thereby simplifying the structure and significantly reducing material costs compared to before.

In addition, the dishwasher according to an embodiment of the present disclosure can prevent a decrease in space utilization by forming the bubble generation flow path inside the spray arm.

In addition, the dishwasher according to an embodiment of the present disclosure can minimize a flow rate of the washing water supplied to the bubble generation flow path and secure the maximum flow rate of the washing water to be supplied to the spray nozzle, thereby preventing deterioration in washing power.

In addition, the dishwasher according to an embodiment of the present disclosure can improve the coupling force by coupling the upper body and the lower body of the spray arm in a fusion method. Further, the application of a separate coupling member is excluded, thereby reducing the number of parts and reducing the manufacturing cost compared to before.

In addition, the dishwasher according to an embodiment of the present disclosure can couple the bubble discharge portion to the main body portion of the spray arm in an insert injection method, while sufficiently securing the coupling force therebetween.

In addition, the dishwasher according to an embodiment of the present disclosure can effectively prevent damage or breakage of the main body portion by adding a deco cover disposed on the upper surface of the main body portion of the spray arm.

In addition to the above aspects, specific aspects of the present disclosure will be described together while explaining specific details for carrying out the present disclosure.

DESCRIPTION OF EXEMPLARY EMBODIMENTS

Figure 1:
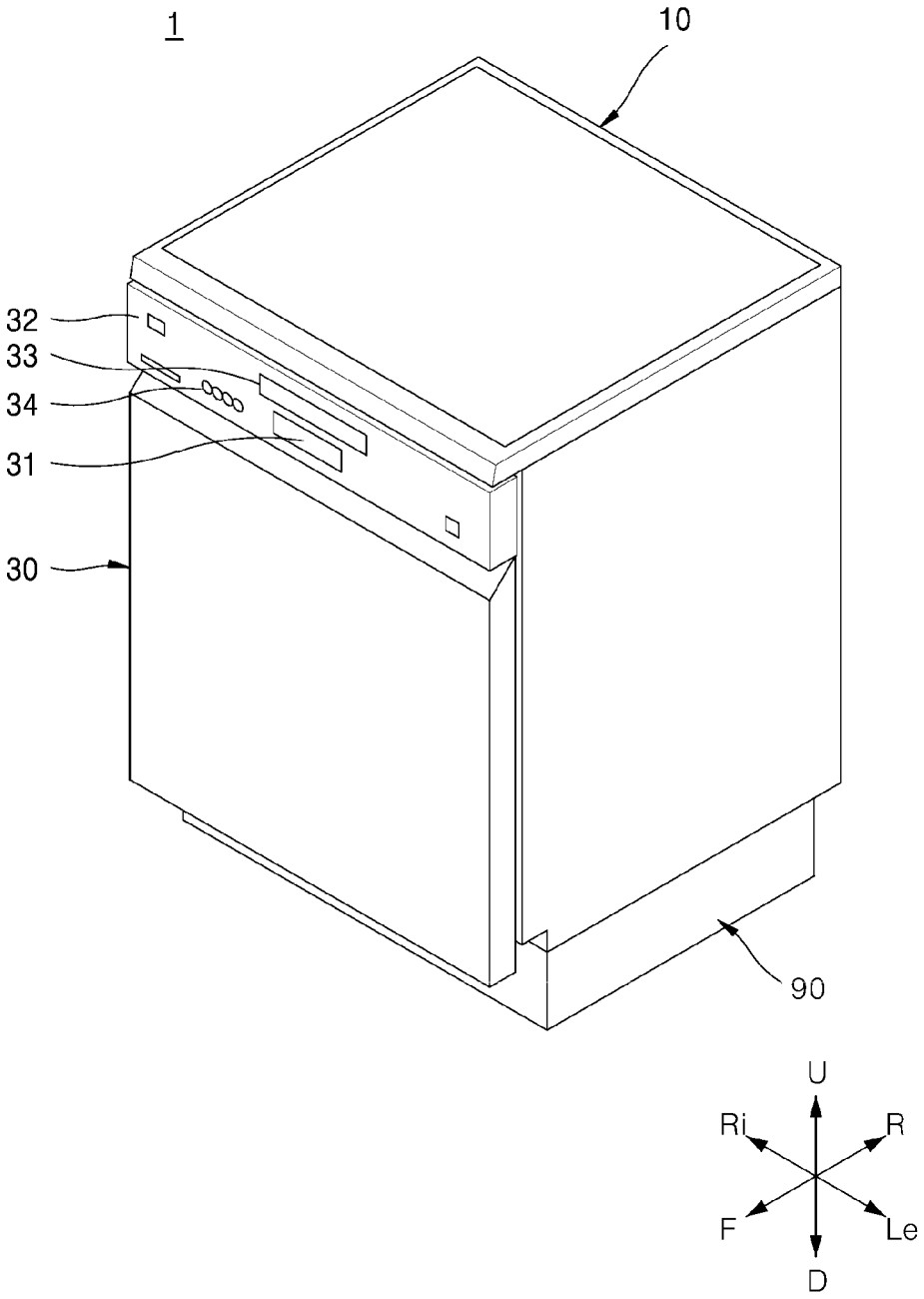
FIG. 1 is a front perspective view of a dishwasher according to an embodiment of the present disclosure.

The above-mentioned objectives, features, and advantages will be described in detail with reference to the accompanying drawings, and accordingly, those of ordinary skill in the art to which the present disclosure pertains should be able to easily practice the technical idea of the present disclosure. In describing the present disclosure, when detailed description of known art related to the present disclosure is deemed as having a possibility of unnecessarily blurring the gist of the present disclosure, the detailed description will be omitted. Hereinafter, exemplary embodiments according to the present disclosure will be described in detail with reference to the accompanying drawings. Like reference numerals in the drawings refer to like or similar elements.

Terms such as first and second are used to describe various elements, but the elements are of course not limited by the terms. The terms are merely used for distinguishing one element from another element, and a first element may also be a second element unless particularly described otherwise.

Through the specification, each element may be singular or plural unless particularly described otherwise.

Hereinafter, when it is said that an arbitrary element is disposed at "an upper portion (or a lower portion)" of an element or disposed "above (or below)" an element, this may not only mean that the arbitrary element is disposed in contact with an upper surface (or a lower surface) of the element, but also mean that another element may be interposed between the element and the arbitrary element disposed above (or below) the element.

Also, when it is said that a certain element is "connected" or "coupled" to another element, this may mean that the elements are directly connected or coupled to each other, but it should be understood that another element may be "interposed" between the elements or the elements may be "connected" or "coupled" to each other via another element.

A singular expression used herein encompasses a plural expression unless the context clearly indicates otherwise. In the present application, terms such as "consisting of" or "including" should not be interpreted as necessarily including all of various elements or various steps described herein and should be interpreted as indicating that some of the elements or some of the steps may not be included or additional elements or steps may be further included.

A singular expression used herein encompasses a plural expression unless the context clearly indicates otherwise. In the present application, terms such as "consisting of" or "including" should not be interpreted as necessarily including all of various elements or various steps described herein and should be interpreted as indicating that some of the elements or some of the steps may not be included or additional elements or steps may be further included.

Throughout the specification, "A and/or B" may refer to A, B, or A and B unless particularly described otherwise, and "C to D" refers to C or more and D or less unless particularly described otherwise.

Hereinafter, the present disclosure will be described with reference to drawings illustrating the configuration of a dishwasher 1 according to an embodiment of the present disclosure.

[Overall Structure of Dishwasher]

Hereinafter, the overall structure of the dishwasher 1 according to an embodiment of the present disclosure will be described in detail with reference to the accompanying drawings.

Figure 2:
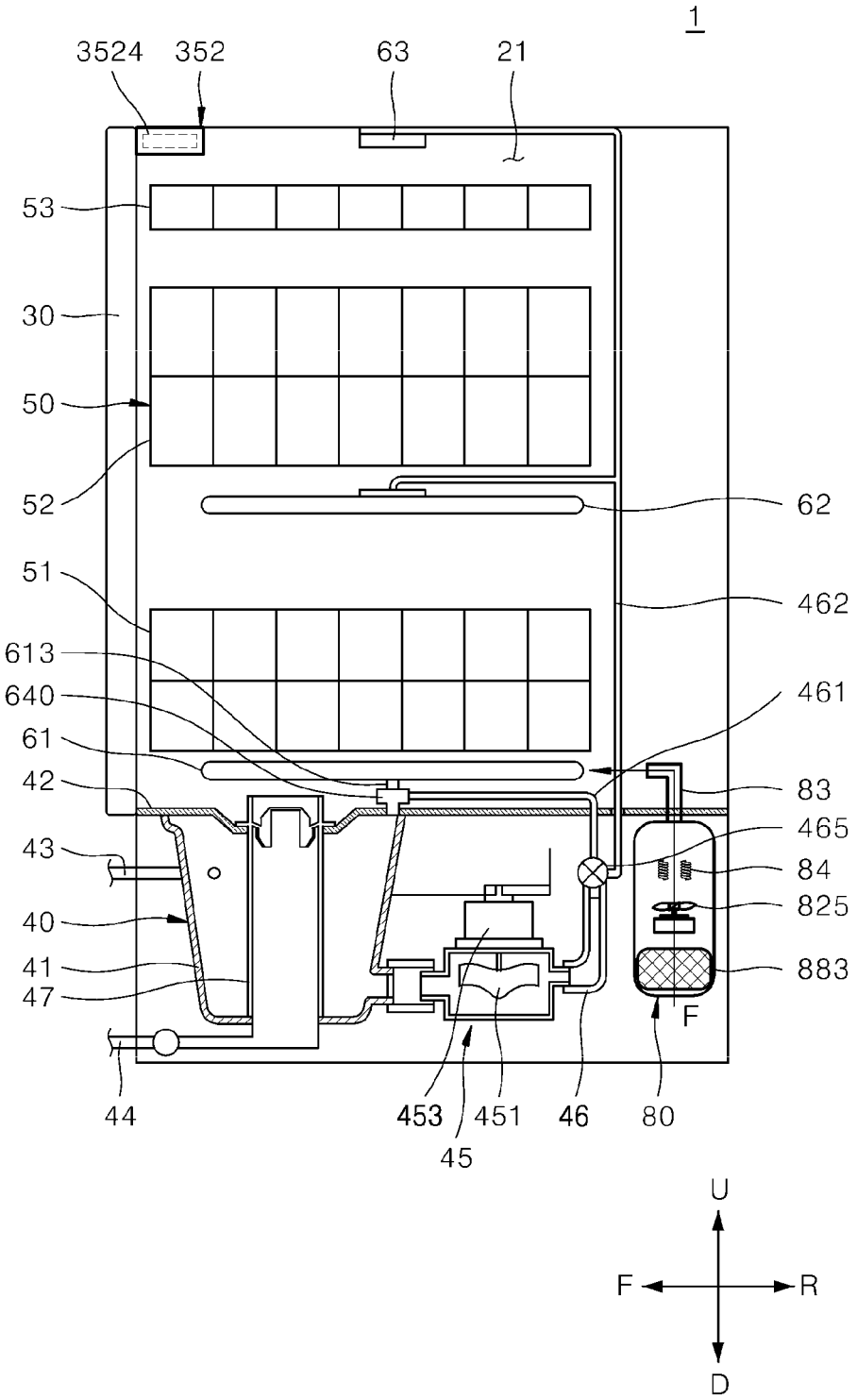
FIG. 2 is a schematic cross-sectional view of the dishwasher illustrated in FIG. 1.

FIG. 1 is a front perspective view of a dishwasher according to an embodiment of the present disclosure, and FIG. 2 is a schematic cross-sectional view of an internal structure of the dishwasher according to an embodiment of the present disclosure.

As illustrated in FIGS. 1 and 2, the dishwasher 1 according to an embodiment of the present disclosure is provided with: a case 10 forming appearance; a tub 20 installed inside the case 10, forming a washing space 21 in which an object to be washed is washed, and having an open front surface; a door 30 for opening and closing the open front surface of the tub 20; a driving portion 40 positioned at a lower portion of the tub 20 and supplying, water collecting, circulating, and draining washing water for washing the object to be washed; a storage portion 50 detachably provided in the washing space 21 inside the tub 20 and in which the object to be washed is seated; and a spray portion 60 installed adjacent to the storage portion 50 and spraying the washing water for washing the object to be washed.

In this connection, the object to be washed seated in the storage portion 50 may be, for example, tableware such as bowls, plates, spoons, chopsticks, and other cooking utensils. Hereinafter, unless otherwise specified, the object to be washed will be referred to as tableware.

The tub 20 may be formed in a box shape with an open front surface as a whole, and corresponds to a configuration known as a so-called washing tub.

The washing space 21 may be formed inside the tub 20, and the open front surface may be opened and closed by the door 30.

The tub 20 may be formed by press processing a metal plate material strongly resistant to high temperature and moisture, for example, a plate material having a stainless-based material.

In addition, on an inner side surface of the tub 20, a plurality of brackets having the purpose of supporting and installing functional configurations such as the storage portion 50 and the spray portion 60 to be described later inside the tub 20 may be disposed.

The driving portion 40 may include: a sump 41 for storing washing water; a sump cover 42 for distinguishing the sump 41 from the tub 20; a water supply portion 43 for supplying the washing water to the sump 41 from an outside; a drainage portion 44 for discharging the washing water of the sump 41 to the outside; a water supply pump 45 and a supply flow path 46 for supplying the washing water of the sump 41 to the spray portion 60; and a filter portion 47 disposed inside the sump 41 and filtering the washing water.

The sump cover 42 may be disposed at an upper side of the sump 41 and may play a role of distinguishing the tub 20 and the sump 41. In addition, the sump cover 42 may be provided with a plurality of recovery holes for recovering the washing water sprayed into the washing space 21 through the spray portion 60 into the sump 41.

In other words, the washing water sprayed from the spray portion 60 toward the dishes may fall onto a lower portion of the washing space 21 and be recovered to the sump 41 again via the sump cover 42.

The water supply pump 45 is provided on a side portion or a lower portion of the sump 41, pressurizes the recovered washing water and resupplies the same to the spray portion 60.

One end of the water supply pump 45 may be connected to the sump 41 and the other end may be connected to the supply flow path 46. The water supply pump 45 may include an impeller 451 and a motor 453. When power is supplied to the motor 453, the impeller 451 may rotate, and the washing water in the sump 41 may be pressurized, and then supplied to the spray portion 60 via the supply flow path 46.

The supply flow path 46 may serve to selectively supply the washing water supplied from the water supply pump 45 to the spray portion 60.

For example, the supply flow path 46 may include a first supply flow path 461 connected to a lower spray arm 61, and a second supply flow path 463 connected to an upper spray arm 62 and a top nozzle 63, and the supply flow path 46 may be provided with a supply flow path switching valve 465 for selectively opening and closing the supply flow paths 461 and 463.

In this connection, the supply flow path switching valve 465 may be controlled so that each of the supply flow paths 461 and 463 are opened sequentially or simultaneously.

The spray portion 60 is provided to spray washing water to dishes stored in the storage portion 50.

In more detail, the spray portion 60 may include the lower spray arm 61 positioned at a lower portion of the tub 20 and spraying washing water to a lower rack 51, the upper spray arm 62 positioned between the lower rack 51 and an upper rack 52 and spraying the washing water to the lower rack 51 and the upper rack 52, and a top nozzle 63 positioned at an upper portion of the tub 20 and spraying the washing water to a top rack 53 or the upper rack 52.

In particular, the lower spray arm 61 and the upper spray arm 62 may be rotatably provided in the washing space 21 of the tub 20 to spray washing water while rotating toward the dishes in the storage portion 50.

The lower spray arm 61 may be rotatably supported on an upper side of the sump cover 42 so as to spray washing water while rotating toward the lower rack 51 from a lower portion of the lower rack 51.

As illustrated, a hub 613 to which washing water is supplied from the first supply flow path 461 may be provided at a lower portion of the lower spray arm. The hub 613 may be rotatably supported by a lower spray arm holder 640 connected to the sump 41.

In addition, the upper spray arm 62 may be rotatably supported by an upper spray arm holder so as to spray washing water while rotating between the lower rack 51 and the upper rack 52.

A member for switching the washing water sprayed from the lower spray arm 61 in an upward direction (U-direction) may be further provided on a lower surface 25 of the tub 20 to increase washing efficiency. Among the configurations of the spray portion 60, the detailed configuration of the lower spray portion 61 will be described later with reference to FIG. 3.

The washing space 21 may include the storage portion 50 for storing dishes.

The storage portion 50 is provided to be withdrawn from an inside of the tub 20 through the open front surface of the tub 20.

For example, FIG. 2 illustrates an embodiment provided with a storage portion including the lower rack 51 positioned at a lower portion of the tub 20 and capable of storing relatively large-sized dishes, the upper rack 52 positioned at an upper side of the lower rack 51 and capable of storing medium-sized dishes, and a top rack 53 positioned at an upper portion of the tub 20 and capable of storing small-sized dishes. Although an embodiment of the present disclosure is not limited thereto, the description will be made based on an embodiment of a dishwasher provided with three storage portions 50 as illustrated.

The lower rack 51, the upper rack 53, and the top rack 53 may be configured to be withdrawn to an outside through the open front surface of the tub 20, respectively.

To this end, guide rails (not shown) may be provided on both side walls forming an inner circumferential surface of the tub 20, and for example, the guide rails may include an upper rail, a lower rail, and a top rail.

Wheels may be provided at a lower portion of each of the lower rack 51, the upper rack 53, and the top rack 53. A user may store dishes by withdrawing the lower rack 51, upper rack 53, and top rack 53 to an outside through the front surface of the tub 20, or easily take out the washed dishes therefrom.

A guide rail 54 may be provided as a fixed guide rail in the form of a simple rail for guiding the withdrawal and introduction of the spray portion 60 or a telescopic guide rail for guiding the withdrawal and storage of the spray portion 60 and increasing a withdrawal distance as the spray portion 60 is withdrawn.

The door 30 is provided to open and close the open front surface of the aforementioned tub 130.

The door 30 is provided with a hinge portion (not shown) at a lower portion of the open front surface thereof, about which the door 30 is hingedly rotated such that the door 30 is opened and closed.

Herein, a handle 31 for opening the door 30 and a control panel 32 for controlling the dishwasher 1 may be provided on an outer side surface of the door 30.

As illustrated, the control panel 32 may be provided with a display 33 for visually displaying information about the current operating state of the dishwasher, and a button portion 34 including a selection button inputting the selection manipulation of a user and a power button inputting the manipulation of the user for turning on/off the power of the dishwasher.

An inner side surface of the door 30 may form one surface of the tub 20 when the door 30 is closed, and simultaneously, may form a seating surface on which the lower rack 51 of the storage portion 50 may be supported when the door 30 is fully opened.

To this end, when the door 30 is fully opened, an inner side surface of the door 30 may horizontally extend from the guide rail 54 for guiding the lower rack 51.

As illustrated in FIG. 2, an automatic door opening module 352 for automatically opening the door may be provided outside the upper surface of the tub 20.

The automatic door opening module 352 moves the door 30 to a predetermined open position when a drying air supply portion 80 described below is operated and the drying air is supplied to the inside of the tub 20, and serves to partially open a front surface 22 of the tub 20.

Accordingly, air humidified while drying dishes may be discharged through the upper side of the front surface 22 of the tub 20 that is opened.

For example, the automatic door opening module 352 may be provided with a push rod 3524 that rotates and moves an upper end of the rear surface of the door 30 to an open position.

The drying air supply portion 80 for generating and supplying high-temperature or low-temperature drying air to a washing space inside the tub 20 may be provided at a lower portion of the tub 20.

As illustrated, the drying air supply portion 80 may include a filter member 883 for filtering external air, a blowing fan 825 for generating a drying air current, a heater 84 for heating the drying air current, and an air current guide 83 disposed inside the tub and guiding the drying air current.

A drying air supply hole 254 may be provided at a lower surface of the tub 20 so that the high-temperature drying air generated by the drying air supply portion may be introduced into the tub 20.

[Detailed Structure of Lower Spray Arm]

Hereinafter, the detailed structure of the lower spray arm 61 provided in the dishwasher 1 according to an embodiment of the present disclosure will be described in detail with reference to the accompanying drawings. Hereinafter, the lower spray arm 61 of the spray portion 60 is exemplarily described, but unless otherwise stated, the configuration below may be applied in a similar manner for the upper spray arm 62 configuring the spray portion 60.

Figure 3:
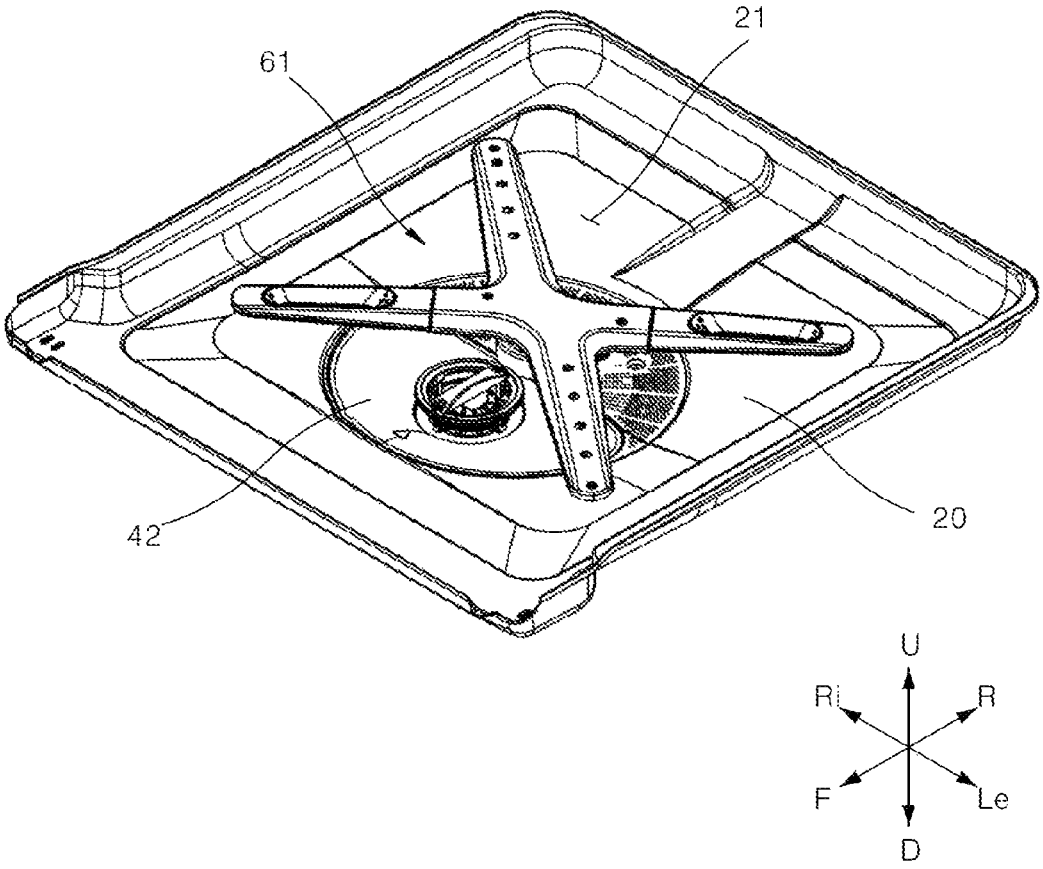
FIG. 3 is a perspective view illustrating a state in which a lower spray arm illustrated in FIG. 2 is disposed in a tub.
Figure 4:
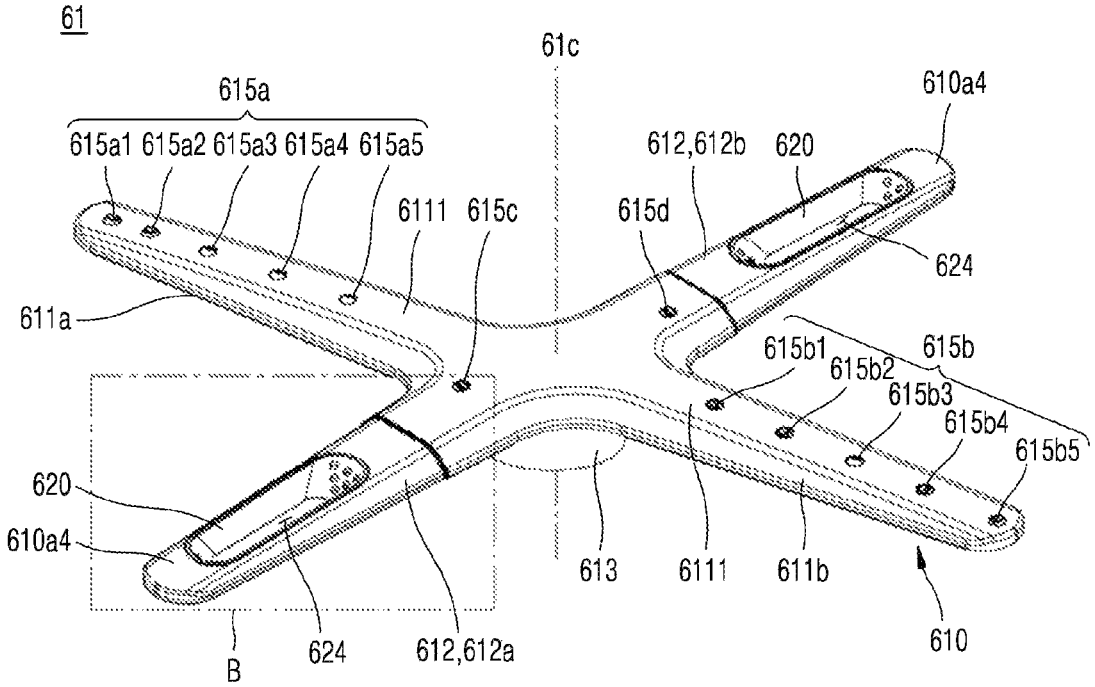
FIG. 4 is a front perspective view of the lower spray arm illustrated in FIG. 3.
Figure 5:
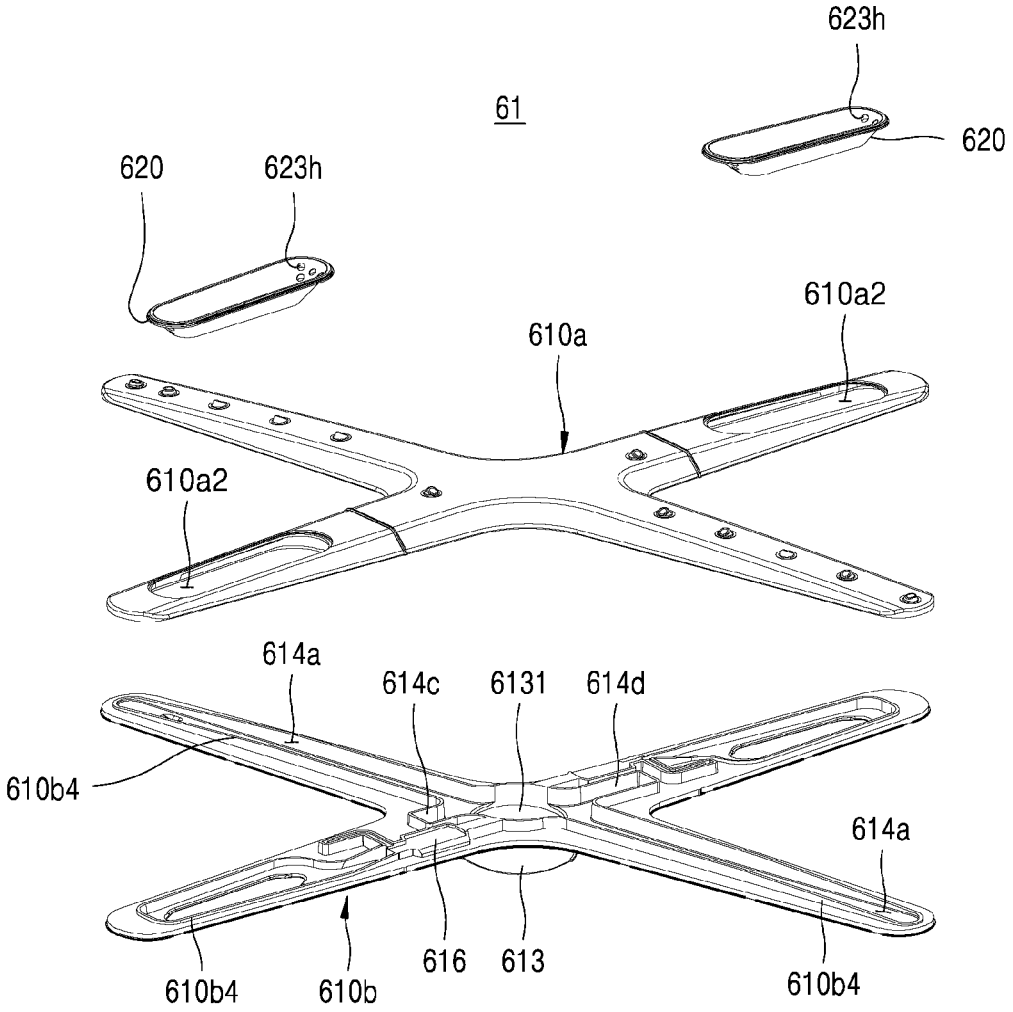
FIG. 5 is an exploded perspective view of the lower spray arm illustrated in FIG. 3.

Referring to FIGS. 3 to 5, the lower spray arm 61 according to the first embodiment of the present disclosure may include: a main body portion 610 serving to spray washing water into the washing space 21 of the tub 20 and supplying microbubbles to the washing space 21; and a hub 613 disposed at a lower central side of the main body portion 610 and supplying the washing water supplied from the aforementioned water supply pump to an inside of the main body portion 610.

In this connection, as illustrated, the main body portion 610 may include first blades 611*a* and 611*b* for spraying washing water into the washing space 21 of the tub 20 and second blades 612*a* and 612*b* for supplying microbubbles to the washing space 21.

An embodiment of the present disclosure is not limited thereto, but as exemplarily illustrated below, the description will be made based on an embodiment in which the lower spray arm 61 includes a pair of first blades 611*a* and 611*b* and a pair of second blades 612*a* and 612*b*.

First, the first blades 611*a* and 611*b* may have a shape extending from the hub 613 in a centrifugal direction.

As illustrated, the first blades 611*a* and 611*b* may linearly extend along the centrifugal direction.

The inside of the first blades 611*a* and 611*b* may extend linearly from the hub 613 along the centrifugal direction, and among the flow paths formed inside the lower spray arm 61, the spray flow paths 614*a* and 614*b* configuring a second flow path may be formed.

In this connection, the spray flow paths 614*a* and 614*b* may be formed so that a cross-sectional area of a flow path decreases as they move away from the hub 613. Thus, the pressure of the washing water inside the spray flow paths 614*a* and 614*b* may be maintained substantially constant regardless of the distance from the hub 613.

In addition, a plurality of spray nozzles 615*a* and 615*b* may be spaced apart from each other along the centrifugal direction on an upper surface 6111 of the first blades 611*a* and 611*b* and are in fluid communication with the spray flow pats 614*a* and 614*b*, respectively.

A plurality of injection nozzles 615*a* and 615*b* provided on the upper surface 6111 of the first blades 611*a* and 611*b* play a role of discharging or spraying the washing water supplied from the water supply pump via the hub 613 through the spray flow paths 614*a* and 614*b* in an upward direction toward the washing space 21.

Figure 8:
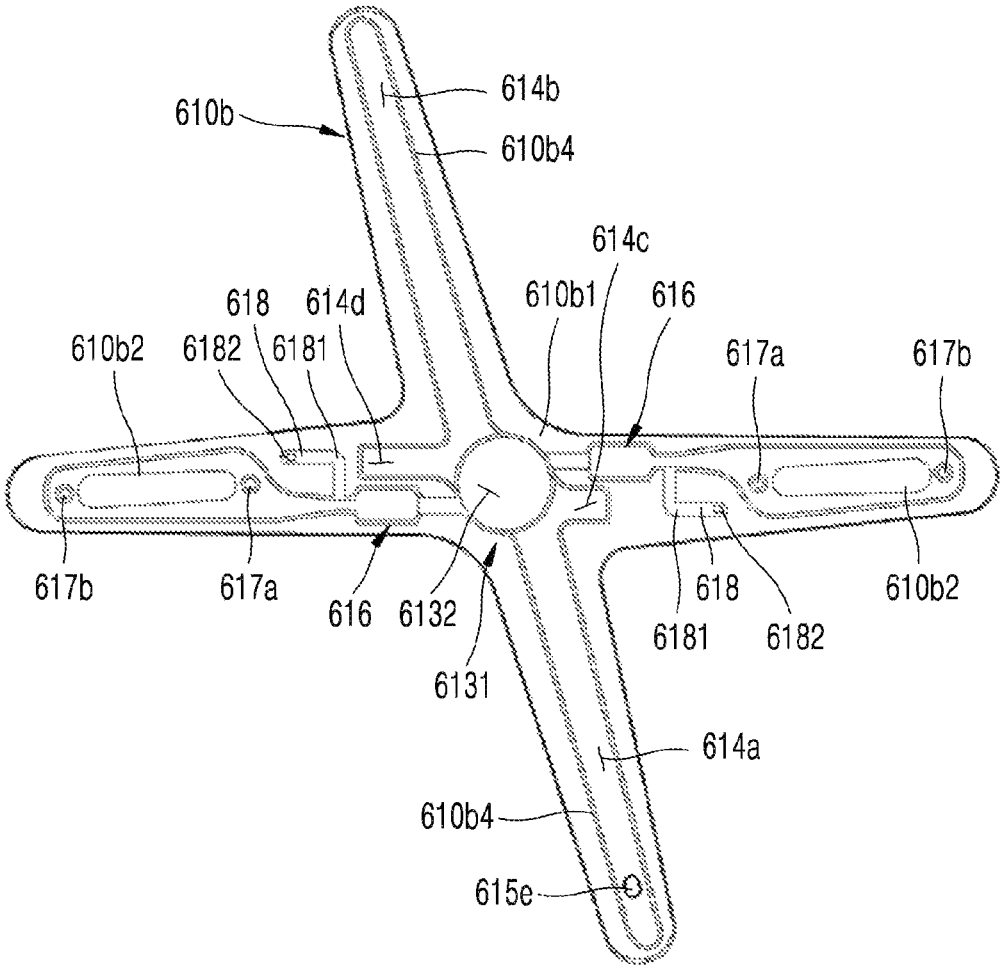
FIG. 8 is a plan view of a lower body configuring the lower spray arm illustrated in FIG. 3.

In addition, as illustrated in FIG. 8, a lower spray nozzle 615*e* in fluid communication with the spray flow paths 614*a* and 614*b* may be disposed on a lower surface of at least one of the first blades 611*a* and 611*b*. The lower spray nozzle 615*e* serves to discharge or spray the washing water supplied through the spray flow paths 614*a* and 614*b* in a downward direction. For example, the lower spray nozzle 615*e* serves to spray washing water toward the sump cover 42 disposed at a lower side of the lower spray arm 61.

Microbubbles may be formed inside a second blade 612, and a bubble generation flow path 616 configuring a part of the first flow path may be formed among flow paths formed inside the lower spray arm 61.

Inside the tub 20 of the dishwasher 1 according to an embodiment of the present disclosure, detergent for washing objects to be washed may be supplied toward the lower surface 25 forming a bottom surface of the tub during a washing process. In order for the supplied detergent to be evenly dissolved and sprayed in the washing water, a predetermined time delay inevitably occurs.

In this connection, when microbubbles having a fine diameter are generated and supplied to the washing water, the microbubbles do not dissolve and may be coupled to the surface of the detergent in an aggregated state.

Accordingly, microbubbles with a fine diameter cause an electrostatic adsorption reaction with the detergent, so that the dissolution rate and spray rate of the detergent are significantly increased compared to the related art, and the detergent can be dissolved more finely than the related art. Thus, the time of the washing process can be significantly shortened and the washing power can be remarkably improved.

The bubble generation flow path 616 provided in the lower spray arm 61 of the dishwasher 1 according to an embodiment of the present disclosure serves to supply the washing water in which these microbubbles are generated.

Unless otherwise described below, microbubbles refer to air bubbles having a size and diameter so small that they cannot be checked with the naked eyes.

A plurality of discharge holes 617*a*, 617*b*, and 623*h* may be formed in the second blade 612 to discharge washing water containing microbubbles generated through the bubble generation flow path 616. In addition, inside the second blade 612, the microbubbles generated through the bubble generation flow path 616 may flow toward the discharge holes 617*a*, 617*b*, and 623*h*, and a discharge flow path 617 configuring the remaining part of the first flow path may be formed. The detailed configurations of the bubble generation flow path 616 and the discharge flow path 617 formed inside the second blade 612 will be described later with reference to FIG. 7.

Additional flow paths 614*c* and 614*d* for spraying washing water into the washing space 21 may be formed inside the second blade 612. The additional flow paths 614*c* and 614*d* may be disposed on one side of a buffer flow path 6162 configuring the bubble generation flow path 616. For example, the additional flow paths 614*c* and 614*d* may be disposed side by side on the side surface of the buffer flow path 6162.

On the upper surface 6111 of the second blade 612, additional spray nozzles 615*c* and 615*d* in fluid communication with the additional flow paths 614*c* and 614*d* and spraying washing water flowing through the additional flow paths 614*c* and 614*d* into the washing space 21 may be disposed.

Figure 6:
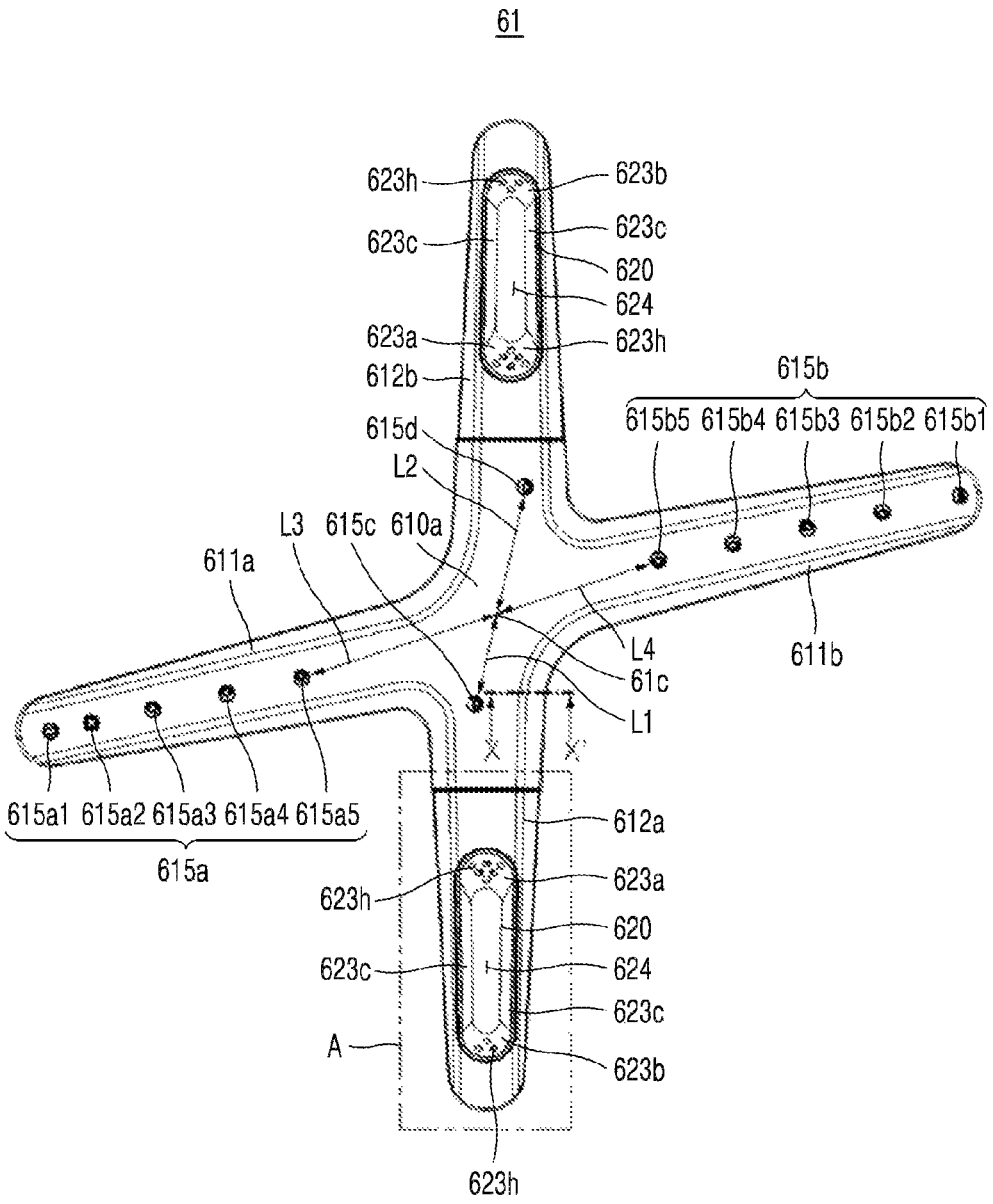
FIG. 6 is a plan view of the lower spray arm illustrated in FIG. 3.

In this connection, as illustrated in FIG. 6, the center of the hub 613 of the additional spray nozzles 615*c* and 615*d*, that is, intervals L1 and L2 spaced apart from the center of the main body portion 610 of the lower spray arm 61, may be different from the center of the hub 613 of the spray nozzles 615*a* and 615*b*, that is, intervals L3 and L4 spaced apparat from the center of the main body portion 610 of the lower spray arm 61. In more detail, the intervals L1 and L2 that the additional spray nozzles 615*c* and 615*d* are spaced apart from the center of the hub 613 may be formed smaller than the intervals L3 and L4 that the spray nozzles 615*a* and 615*b* are spaced apart from the center of the hub 613.

As illustrated in FIGS. 4 to 6, the pair of first blades 611*a* and 611*b* and the pair of second blades 612 configuring the lower spray arm 61 may be disposed to cross each other.

The pair of first blades 611*a* and 611*b* may each form spray flow paths 614*a* and 614*b* therein, and may include a 1-1 blade 611*a* and a 1-2 blade 611*b* extending in opposite directions to each other.

A first spray flow path 614*a* may be formed inside the 1-1 blade 611*a*, and a second spray flow path 614*b* may be formed inside the 1-2 blade 611*b*.

A plurality of first spray nozzles 615*a*1, 615*a*2, 615*a*3, 615*a*4, and 615*a*5 may be disposed in a row on the upper surface of the 1-1 blade 611*a*, and a plurality of second spray nozzles 615*b*1, 615*b*2, 615*b*3, 615*b*4, and 615*b*5 may be disposed in a row on the upper surface of the 1-2 blade 611*b*.

In this connection, the distance that the plurality of first spray nozzles 615*a*1, 615*a*2, 615*a*3, 615*a*4, and 615*a*5 and the plurality of second spray nozzles 615*b*1, 615*b*2, 615*b*3, 615*b*4, and 615*b*5 are each spaced apart from a rotational center 61*c* of the lower spray arm 61 may be formed differently from each other.

The pair of second blades 612 may each form the bubble generation flow path 616 therein, and may include a 2-1 blade 612*a* and a 2-2 blade 612*b* extending in opposite directions to each other.

Inside the 2-1 blade 612*a*, a first bubble generation flow path 616*a* and a first additional flow path 614*c* may be formed, and inside the 2-2 blade 612*b*, a second bubble generation flow path 616*b* and a second additional flow path 614*d* may be formed.

The aforementioned first additional spray nozzle 615*c* may be disposed on the upper surface of the 2-1 blade 612*a*, and the aforementioned second additional spray nozzle 615*d* may be disposed on the upper surface of the 2-2 blade 612*b*. In this connection, the distance that the first additional spray nozzle 615*c* and the second additional spray nozzle 615*d* each spaced apart from the rotational center 61*c* of the lower spray arm 61 may be formed to be the same or different from each other.

The supply flow path 6131 extending in a vertical direction may be formed inside the hub 613. The supply flow path 6131 may have a structure in which an upper end is closed and a lower end is open. An open lower end of the supply flow path 6131 may function as an opening 6132 into which washing water is introduced. Accordingly, the washing water supplied from the water supply pump through the lower end may be introduced through the opening 6132.

An upper portion of the supply flow path 6131 may be connected to the spray flow paths 614*a* and 614*b* of the aforementioned first blades 611*a* and 611*b*. In addition, an upper portion of the supply flow path 6131 may be connected to the bubble generation flow path 616 of the second blade 612. Accordingly, the washing water flowing upward along the supply flow path 6131 may branch and flow along the spray flow paths 614*a* and 614*b* and the bubble generation flow path 616.

Referring to FIG. 5, for example, the main body portion 610 of the lower spray arm 61 may have a structure divided along a vertical direction in consideration of a flow path structure including the first flow path and the second flow path formed therein. As illustrated, the main body portion 610 may include an upper body 610*a* configuring a divided upper portion and a lower body 610*b* coupled to a lower side of the upper body 610*a* and configuring a divided lower portion. The upper body 610*a* and the lower body 610*b* may be separately manufactured through plastic injection molding.

In this connection, the upper body 610*a* and the lower body 610*b*, each separately manufactured through plastic injection molding, may be coupled to each other through fusion, and may be exemplarily coupled through a vibration fusion method.

To this end, at least one of the upper body 610*a* and the lower body 610*b* may be formed with a fusion rib 610*a*3 protruding in a direction toward the other one and fixed by fusion.

Figure 7:
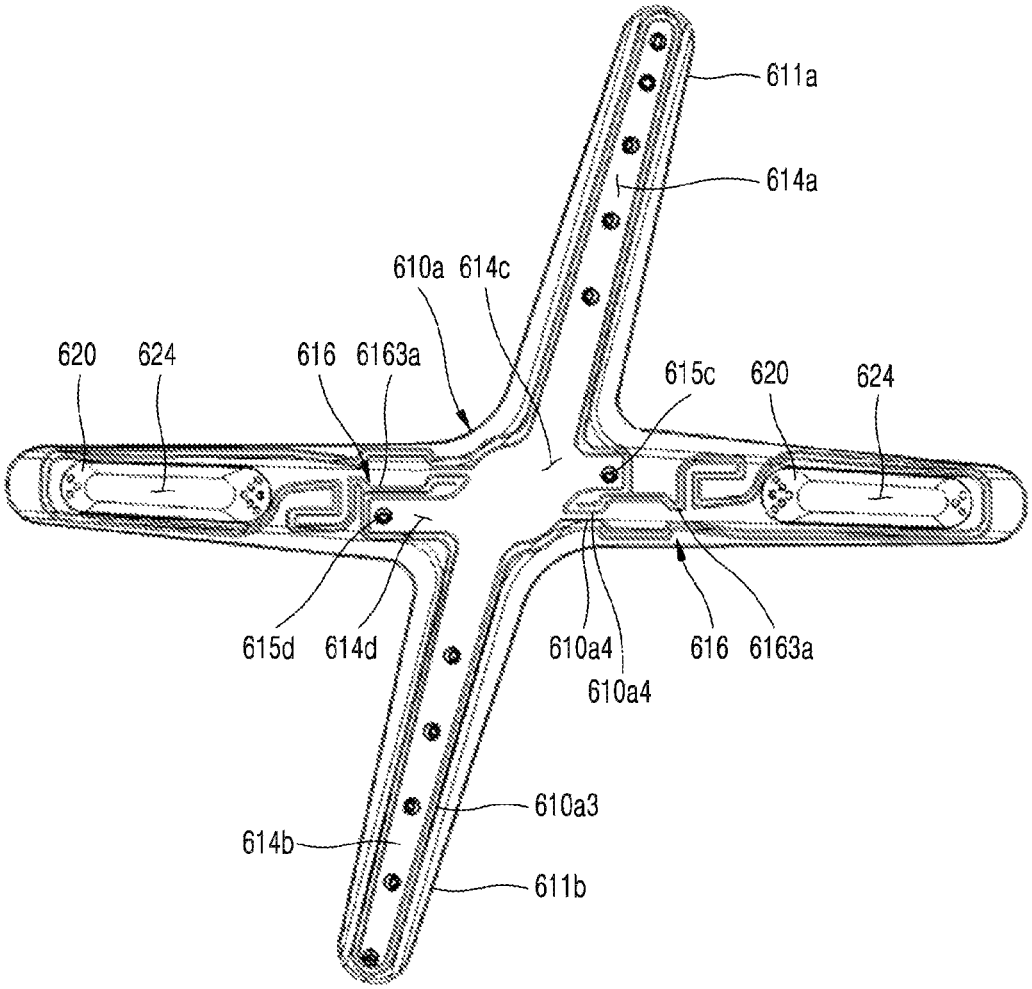
FIG. 7 is a bottom view of an upper body configuring the lower spray arm illustrated in FIG. 3.

As illustrated in FIG. 7, for example, the fusion rib 610*a*3 may be disposed to protrude in a barrier form along a lower direction from an inner bottom surface 610*a*1 of the upper body 610*a* toward the lower body 610*b*. As illustrated, the fusion rib 610*a*3 may be disposed outside the first flow path forming rib 610*a*4 forming a portion of the aforementioned spray flow paths 614*a* and 614*b*, the additional flow paths 614*c* and 614*b*1, the bubble generation flow path 616, and the discharge flow path 617, that is, the upper portion thereof.

In this connection, the lower end of the fusion rib 610*a*3 may be fused by directly contacting an upper surface 610*b*1 of the lower body 610*b*. A coupling structure through fusion between the upper body 610*a* and the lower body 610*b* will be described later with reference to FIGS. 17 to 20.

A second flow path forming rib 610*b*4 protruding along an upper direction and forming the remaining portion of the aforementioned spray flow paths 614*a* and 614*b*, the additional flow paths 614*c* and 614*b*1, the bubble generation flow path 616, and the discharge flow path 617, that is, the lower portion thereof, may be disposed on the upper surface 610*b*1 of the lower body 610*b* facing the upper body 610*a*.

The lower end of the first flow path forming rib 610*a*4 and the upper end of the second flow path forming rib 610*b*4 may be coupled to each other to form a first flow path and a second flow path serving as an internal flow path as a washing water flow path through which washing water flows. The internal flow path may be the spray flow paths 614*a* and 614*b*, the additional flow paths 614*c* and 614*b*1, the bubble generation flow path 616, and the discharge flow path 617 as described above.

More specifically, the internal flow path may be formed in the form of a closed channel where the inner bottom surface 610*a*1 of the upper body 610*a* acts as an upper side surface, the upper surface 610*b*1 of the lower body 610*b* acts as a lower side surface, and the flow path forming ribs 610*a*4 and 610*b*4 acts as a left side surface and a right side surface.

In this connection, as will be described later, the lower end of the first flow path forming rib 610*a*4 and the upper end of the second flow path forming rib 610*b*4 may be configured to be partially fusion-coupled to each other when the upper body 610*a* and the lower body 610*b* are fusion-coupled. In other words, the protruding heights of each of the first flow path forming rib 610*a*4 and the second flow path forming rib 610*b*4 may be adjusted so that fusion occurs in some sections and no fusion occurs in other sections.

The 2-1 blade 612*a* and the 2-2 blade 612*b* may each have a bubble discharge portion 620 having a vertical hole 624 penetrating the upper body 610*a* and the lower body 610*b* in a vertical direction.

The vertical hole 624 of the bubble discharge portion 620 is opened to penetrate the 2-1 blade 612*a* and the 2-2 blade 612*b* in a vertical direction. The vertical hole 624 may be formed to have a funnel shape with an upper surface having a larger cross-sectional area than a lower surface so that the washing water containing microbubbles may smoothly fall toward the bottom surface of the tub 20, that is, a bottom tub 20*c*.

For example, as illustrated, the bubble discharge portion 620 may be integrally provided with the upper body 610*a* or may be formed separately from the upper body 610*a* and coupled to the upper body 610*a*. In the illustrated embodiment, a configuration in which the bubble discharge portion 620 is manufactured separately from the upper body 610*a* is illustrated. Although an embodiment of the present disclosure is not limited thereto, hereinafter, an embodiment in which the bubble discharge portion 620 is manufactured separately from the upper body 610*a* and coupled to the upper body 610*a* will be described.

The separately manufactured bubble discharge portion 620 may be exemplarily coupled to the upper body 610*a* by an insert injection method.

Figure 23:
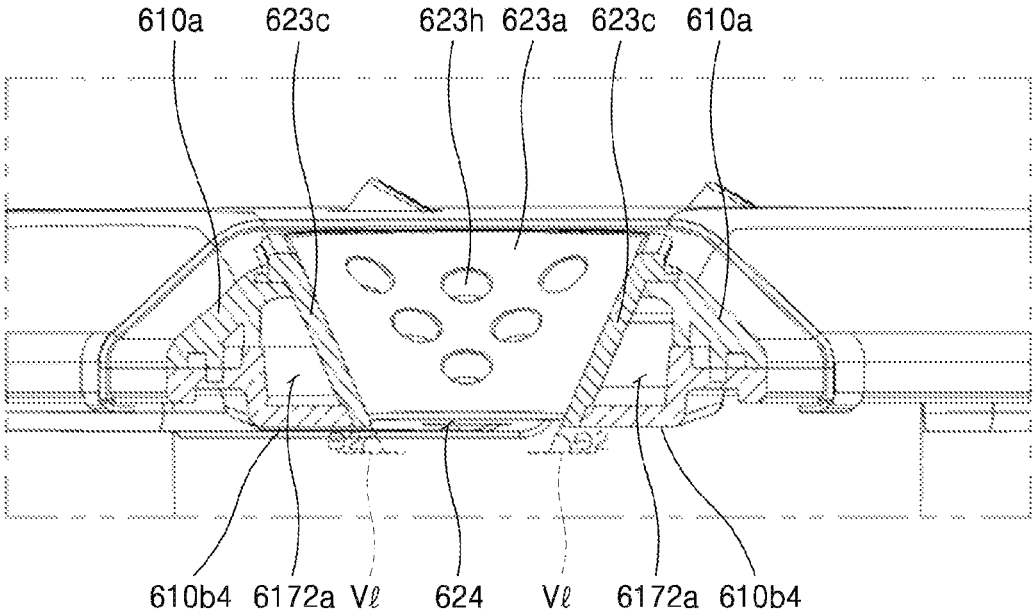
FIG. 23 is a cross-sectional view taken along a Y-Y' direction illustrated in FIG. 21.

More specifically, the upper end of the separately provided bubble discharge portion 620 may be fixed to the upper body 610*a* by an insert injection method, and the lower end may be coupled to the upper body 610*a* and the lower body 610*b* in a way that is simply inserted into a lower coupling hole 610*b*2 of the lower body 610*b*. A detailed configuration of the coupling between the upper body 610*a* and the lower body 610*b* of the bubble discharge portion 620 will be described later with reference to FIG. 23 below.

The bubble discharge portion 620 serves to discharge washing water containing microbubbles generated in the bubble generation flow path 616 to the washing space. To this end, a plurality of first discharge holes 623*h* may be formed on one side surface of the bubble discharge portion 620. For example, the plurality of first discharge holes 623*h* may be provided in at least one of a centrifugal first short side portion 623*a* and a centrifugal second short side portion 623*b* of the wall portion 623 configuring the bubble discharge portion 620.

As described above, in order to implement the funnel-shaped vertical hole 624, the bubble discharge portion 620 may have a shape in which an internal cross-sectional area decreases while extending from an upper side to a lower side. To this end, the bubble discharge portion 620 may include the wall portion 623 whose tube diameter decreases from the upper side to the lower side.

Accordingly, since the first discharge hole 623*h* is formed in the centrifugal first short side portion 623*a* or the centrifugal second short side portion 623*b* of the wall portion

623, the first discharge hole 623*h* may be opened in a horizontal direction or opened toward an upper direction.

Thus, the washing water passing through the spray nozzles 615*a* and 615*b* of the first blades 611*a* and 611*b* may fall toward the first discharge hole 623*h* of the bubble discharge portion 620. Accordingly, the washing water passing through the spray nozzles 615*a* and 615*b* collides with the washing water discharged through the first discharge hole 623*h*, and the microbubbles may be additionally crushed. The specific structure and form of the bubble discharge portion 620 will be described below with reference to FIG. 23.

[Detailed Configuration of Bubble Generation Flow Path]

Hereinafter, a detailed configuration of the bubble generation flow path 616 according to an embodiment of the present disclosure will be described with reference to FIGS. 9 to 16.

The bubble generation flow path 616 may include: a connection flow path 6161 fluidly connected to a supply flow path 6131 of the hub 613; the buffer flow path 6162 fluidly connected to the connection flow path 6161 and having a larger flow path cross-sectional area than the connection flow path 6161; and an air suction flow path 6163 fluidly connected to the buffer flow path 6162 and through which external air is introduced.

FIGS. 9 to 14 illustrate the bubble generation flow path 616 in which the cross section of the flow path is a square. First, with reference to FIGS. 9 to 14, an embodiment of the bubble generation flow path 616 in which the cross section of the flow path is a square will be described.

First, the connection flow path 6161 configuring the most upstream of the bubble generation flow path 616 based on a flow direction of the washing water is connected to the supply flow path 6131 of the hub 613, and serves to receive a portion of the washing water from the hub 613. The connection flow path 6161 may supply the washing water flowing from the supply flow path 6131 to the buffer flow path 6162.

As illustrated, in order to minimize the flow loss of the washing water, the supply flow path 6131 may extend approximately linearly along the longitudinal direction of the second blades 612*a* and 612*b*, and the flow path cross-sectional area of the supply flow path 6131 may be maintained substantially constant while proceeding along a flow direction.

In this connection, the flow path cross-sectional area of the connection flow path 6161 may be formed smaller than the flow path cross-sectional area of the spray flow paths 614*a* and 614*b*. Accordingly, the flow rate of the washing water flowing along the connection flow path 6161 may be maintained at a small amount lower than the flow rate of the washing water flowing along the spray flow paths 614*a* and 614*b*.

The buffer flow path 6162 disposed on a downstream side of the connection flow path 6161 may include: an expansion portion 6162*a* expanding a cross-sectional area of a flow path while proceeding along a flow direction of washing water; a retaining portion 6162*b* retaining the cross-sectional area of the flow path while proceeding along the flow direction of the washing water; and a contraction portion 6162*c* contracting the cross-sectional area of the flow path while proceeding along the flow direction of the washing water.

The expansion portion 6162*a* is disposed between a discharge end of the connection flow path 6161 and the retaining portion 6162*b*, and serves to minimize flow loss by gradually expanding the cross-sectional area of the flow path. In the illustrated embodiment, there is illustrated a configuration in which the flow path cross-sectional area of the expansion portion 6162*a* is linearly expanded while proceeding along the flow direction. However, an embodiment of the present disclosure is not limited thereto, and the flow path cross-sectional area of the expansion portion 6162*a* may be configured to expand non-linearly while proceeding along the flow direction.

The cross-sectional area of the flow path formed in the expansion portion 6162*a* may be formed larger than the cross-sectional area of the flow path of the connection flow path 6161.

Figure 10:
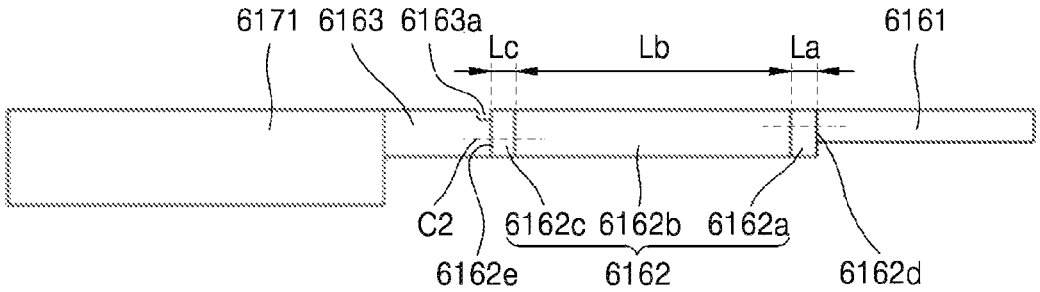
FIG. 10 is a side view of FIG. 9.
Figure 11:
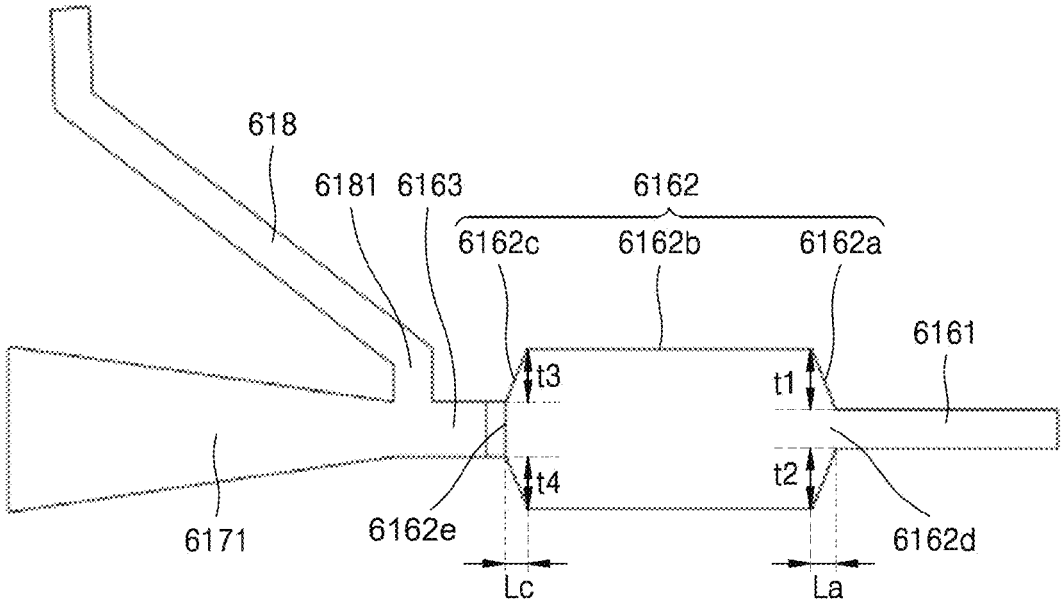
FIG. 11 is a plan view of FIG. 9.
Figure 13:
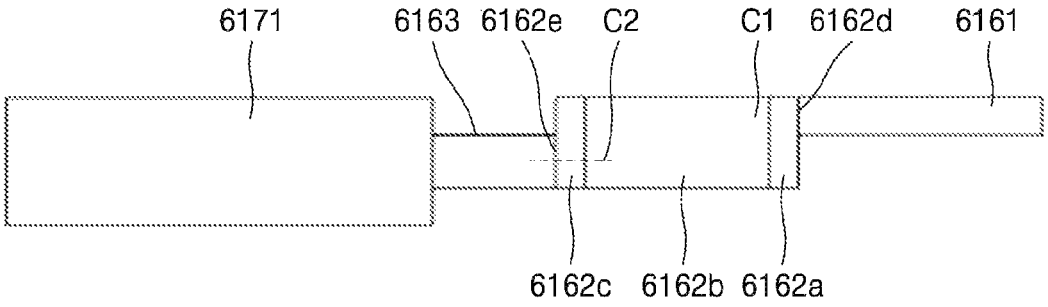
FIG. 13 is a side view of FIG. 12.

In more detail, as illustrated in FIGS. 10 and 13, the cross-sectional area of the flow path may be formed larger at an inlet end of the expansion portion 6162*a* than at the discharge end of the connection flow path 6161. Accordingly, the washing water flowing through the connection flow path 6161 may be introduced into the expansion portion 6162*a* of the buffer flow path 6162 and the flow rate may be rapidly decreased.

In addition, as described above, since the cross-sectional area of the flow path gradually expands as the expansion portion 6162*a* proceeds in the flow direction of the washing water, flow loss due to generation of vortex may be minimized. Accordingly, the flow rate of the washing water introduced into the expansion portion 6162*a* may be further reduced while the flow loss is minimized.

The length La of the expansion portion 6162*a* extended along the flow direction of the washing water may be formed shorter than a length Lb of the retaining portion 6162*b* extended along the flow direction of the washing water. In addition, the length La of the expansion portion 6162*a* extended along the flow direction of the washing water may be formed shorter than the length t1+t2 of the expansion portion 6162*a* expanded in a width direction. Accordingly, reduction in the volume and capacity of the retaining portion 6162*b* may be minimized, and thus, the internal volume and capacity of the buffer flow path 6162 may be secured to the maximum.

The retaining portion 6162*b* corresponds to a portion where the flow path cross-sectional area expanded by the expansion portion 6162*a* is maintained. As illustrated, the width of the retaining portion 6162*b* in a direction crossing the flow direction of the washing water may be maintained substantially constant while proceeding along the flow direction of the washing water.

The contraction portion 6162*c* is disposed between the retaining portion 6162*b* and the air suction flow path 6163, and serves to minimize flow loss due to a rapid decrease in the flow path cross-sectional area by gradually reducing the flow path cross-sectional area. In the illustrated embodiment, similar to the aforementioned expansion portion 6162*a*, a configuration in which the flow path cross-sectional area of the contraction portion 6162*c* is linearly expanded while progressing along the flow direction is illustrated. Similar to the expansion portion 6162*a*, the flow path cross-sectional area of the contraction portion 6162*c* may be configured to expanded non-linearly while proceeding along the flow direction.

As illustrated, the flow path formed inside the constriction portion 6162*c* may be connected to the air suction flow path 6163 at a discharge end side. Herein, the discharge end of the constriction portion 6162*c* may be an outlet 6162*e* of the buffer flow path 6162.

Contrary to the expansion portion 6162*a*, the contraction portion 6162*c* proceeds along the flow direction and gradually reduces the cross-sectional area of the flow path, so that the flow rate of the flowing washing water may gradually increase but the pressure may gradually decrease.

In this connection, like the expansion portion 6162*a*, a length Lc of the contraction portion 6162*c* extended along the flow direction of the washing water may be formed shorter than the length Lb of the retaining portion 6162*b* extended along the flow direction of the washing water.

In addition, the length Lc of the contraction portion 6162*c* extended along the flow direction of the washing water may be formed shorter than the length t3+t4 of the contraction portion 6162*c* reduced in the width direction.

However, the length Lc of the contraction portion 6162*c* extended along the flow direction of the washing water may be formed at a level similar to the length La of the expansion portion 6162*a* extended along the flow direction of the washing water. For example, the length Lc of the contraction portion 6162*c* extended along the flow direction of the washing water may be formed 0.8 to 1.2 times the length La of the expansion portion 6162*a* extended along the flow direction of the washing water.

In this connection, as illustrated, the flow path formed inside the buffer flow path 6162 maybe formed to have a constant height in a vertical direction over the entire area.

An inlet 6162*d* connected to the connection flow path 6161 and an outlet 6162*e* connected to the air suction flow path 6163 may be formed in the buffer flow path 6162. The inlet 6162*d* may be a hole or flow path formed at an inlet end side of the buffer flow path 6162. The outlet 6162*e* may be a hole or flow path formed at a discharge end side of the buffer flow path 6162.

Herein, when the position of a center C1 of the inlet 6162*d* formed in the buffer flow path 6162 is formed to be the same as the position of the center of the outlet 6162*e*, there may be little change in the flow rate of the washing water flowing through the inlet 6162*d* to the outlet 6162*e*. Furthermore, it is possible that the pressure of the washing water flowing through the air suction flow path 6163 is formed higher than atmospheric pressure. As such, when the flow rate change does not effectively occur inside the buffer flow path 6162, the rate at which external air is suctioned into the air suction flow path 6163 is highly likely to be low, and microbubbles may not be actively formed.

In order to prevent the pressure of the washing water in the air suction flow path 6163 from being higher than atmospheric pressure, the inlet 6162*d* and the outlet 6162*e* formed in the buffer flow path 6162 may be formed so that the respective positions of centers C1 and C2, in particular, the position in a vertical direction or the position in a width direction of the centers C1 and C2, are different from each other. In other words, the positions of inlet 6162*d* and outlet 6162*e* may be determined so that a straight line passing through the center C1 of the inlet 6162*d* and being perpendicular to the inlet 6162*d* and a straight line passing through the center C2 of the outlet 6162*e* and being perpendicular to the outlet 6162*e* are not aligned at least on the same straight line.

Herein, the center C1 of the inlet 6162*d* may mean the center of a hole or flow path forming the inlet 6162*d*. Similarly, the center C2 of the outlet 6162*e* may mean the center of a hole or flow path forming the outlet 6162*e*.

First, as illustrated in FIGS. 10 and 13, the center C1 of the inlet 6162*d* of the buffer flow path 6162 may be formed higher than the center C2 of the outlet 6162*e* of the buffer flow path 6162 in a vertical direction. In other words, the positions of the inlet 6162*d* and the outlet 6162*e* may be determined so that a straight line passing through the center C1 of the inlet 6162*d* and being perpendicular to the inlet 6162*d* is formed on an upper side than a straight line passing through the center C2 of the outlet 6162*e* and being perpendicular to the outlet 6162*e*.

However, unlike the configurations illustrated in FIGS. 10 and 13, the configuration in which the center C1 of the inlet 6162*d* of the buffer flow path 6162 and the center C2 of the outlet 6162*e* of the buffer flow path 6162 are disposed to be spaced apart along a width direction of the buffer flow path 6162 is also applicable. In this connection, the straight line passing through the center C1 of the inlet 6162*d* and being perpendicular to the inlet 6162*d* and the straight line passing through the center C2 of the outlet 6162*e* and being perpendicular to the outlet 6162*e* may be disposed in parallel while being spaced apart from each other along the width direction.

As such, the center C1 of the inlet 6162*d* of the buffer flow path 6162 and the center C2 of the outlet 6162*e* of the buffer flow path 6162 are formed at positions to be crossed each other in the width direction in a vertical direction or a width direction, the flow rate reduction performance of the washing water inside the buffer flow path 6162 may be further improved.

In addition, the cross-sectional area of the inlet 6162*d* formed in the buffer flow path 6162 and the cross-sectional area of the outlet 6162*e* may be different from each other. More specifically, the cross-sectional area of the inlet 6162*d* formed in the buffer flow path 6162 may be formed smaller than the cross-sectional area of the outlet 6162*e*.

The cross-sectional area of the outlet 6162*e* formed in the buffer flow path 6162 may be formed to have a size corresponding to that of the air suction flow path 6163. The cross-sectional area of the outlet 6162*e* formed in the buffer flow path 6162 may be formed at a level at which the pressure of washing water flowing through the air suction flow path 6163 may form a negative pressure lower than atmospheric pressure.

In addition, the cross-sectional area of the inlet 6162*d* formed in the buffer flow path 6162 may be formed to correspond to the flow path cross-sectional area of the connection flow path 6161.

Preferably, the cross-sectional area of the inlet 6162*d* formed in the buffer flow path 6162 may be formed to have a size capable of controlling the flow rate of washing water flowing into the connection flow path 6161.

To this end, an inner protrusion 6163*a* protruding to one side of the outlet 6162*e* to change the position of the center C2 of the outlet 6162*e* may be formed inside the main body portion 610 of the lower spray arm 61. In order to change the center of the outlet 6162*e*, the inner protrusion 6163*a* may be formed to protrude toward the outlet 6162*e* from the inner bottom surface 610*a*1 of the upper body 610*a* or the upper surface 610*b*1 of the lower body 610*b*.

FIG. 10 exemplarily illustrates a configuration in which the inner protrusion 6163*a* is formed to protrude downward from the inner bottom surface 610*a*1 of the upper body 610*a* toward the outlet 6162*e* in a stepped shape. However, an embodiment of the present disclosure is not limited thereto, and it is also applicable that the inner protrusion 6163*a* is provided only on the lower body 610*b* or is provided both on the lower body 610*b* and the upper body 610*a*.

As such, the inner protrusion 6163*a* protruding toward the outlet 6162*e* in a stepped shape may move downward from the center C2 of the outlet 6162*e* of the buffer flow path 6162. Accordingly, the separation interval between the center C1 of the inlet 6162*d* and the center C2 of the outlet 6162*e* of the buffer flow path 6162 may be increased.

As such, the buffer flow path 6162 is formed such that the position of the center C1 of the inlet 6162*d* and the position of the center C2 of the outlet 6162*e* are different from each other, so that while flowing into the buffer flow path 6162 through the inlet 6162*d*, the washing water may be discharged through the outlet 6162*e* while the flow rate is gradually increased while moving through the contraction portion 6162*c* after the flow rate is sufficiently reduced inside the buffer flow path 6162.

The expansion portion 6162*a* may start with a flow path cross-sectional area larger than that of the inlet 6162*d*. Referring to FIGS. 10 and 13, for example, the expansion portion 6162*a* may start in a state in which the expansion portion 6162*a* expands downward from the inlet 6162*d* of the buffer flow path 6162 formed following the connection flow path 43.

The air suction flow path 6163 is connected to the buffer flow path 6162. The washing water passing through the buffer flow path 6162 may flow through the air suction flow path 6163.

The flow path cross-sectional area of the air suction flow path 6163 may be formed smaller than the flow path cross-sectional area of the buffer flow path 6162. In particular, the size of the flow path cross-sectional area of the air suction flow path 6163 may be formed smaller than the size of the flow path cross-sectional area of the flow path formed in the retaining portion 6162*b*. Accordingly, a negative pressure lower than atmospheric pressure may be formed while the flow rate of the washing water flowing through the air suction flow path 6163 rapidly increases.

The aforementioned air flow passage 618 may be connected to one side of the air suction flow path 6163. More specifically, the air flow passage 618 may be connected to the downstream end of the air suction flow path 6163, that is, closer to a downstream end than an upstream end. Accordingly, through a suction hole 6182 formed on one side of the lower spray arm 61 and communicating with the washing space 21, the external air may be flowed in the air flow passage 618 at a position closer to the discharge flow path 617 than to the buffer flow path 6162 via the air suction flow path 6163. In other words, air in the washing space 21 may be introduced into the air flow passage 618 via the air suction flow path 6163.

The air flow passage 618 may be connected to a right side surface or a left side surface of the air suction flow path 6163. In particular, the air flow passage 618 may be connected to the right side surface or the left side surface of the air suction flow path 6163 at a position where the discharge end of the air suction flow path 6163 is formed. Accordingly, the flow of air flowed in the air suction flow path 6163 to the buffer flow path 6162 may be minimized.

The suction hole 6182 may be formed on a lower surface of the lower spray arm 61. In more detail, as illustrated in FIG. 8, the suction hole 6182 may be formed through the lower body 610*b* from the upper surface 610*b*1 to the lower surface. Thus, washing water falling from an upper side may be prevented from flowing in the air flow passage 618 through the suction hole 6182.

The air flow passage 618 may include at least one bending portion 6181 in which a flow direction of the flow path is changed. The air flow passage 618 may be vertically connected to the air suction flow path 6163 through the bending portion 6181. Accordingly, the air flowing from the air flow passage 618 to the air suction flow path 6163 may be flowed substantially perpendicular to the flow direction of the washing water flowing through the air suction flow path 6163.

As such, since the air flowed in the air suction flow path 6163 may be flowed perpendicularly to the flow direction of the washing water flowing through the air suction flow path 6163, the air primarily rubs against and collides with the flowing washing water may be crushed.

The discharge flow path 617 configuring the remaining portion of the second flow path may be further connected to a downstream side of the air suction flow path 6163. More specifically, a first discharge flow path 6171 among the discharge flow paths 617 may be connected to the downstream side of the air suction flow path 6163. The first discharge flow path 6171 may be configured such that the cross-sectional area of the flow path gradually expands from an inlet end connected to the air suction flow path 6163 while proceeding along a flow direction of the washing water.

As illustrated in FIGS. 9 to 14, the first discharge flow path 6171 may have a form in which the cross-sectional area of the flow path expands as it moves in a flow direction of the washing water, and the cross-section of the flow path becomes square.

Figure 9:
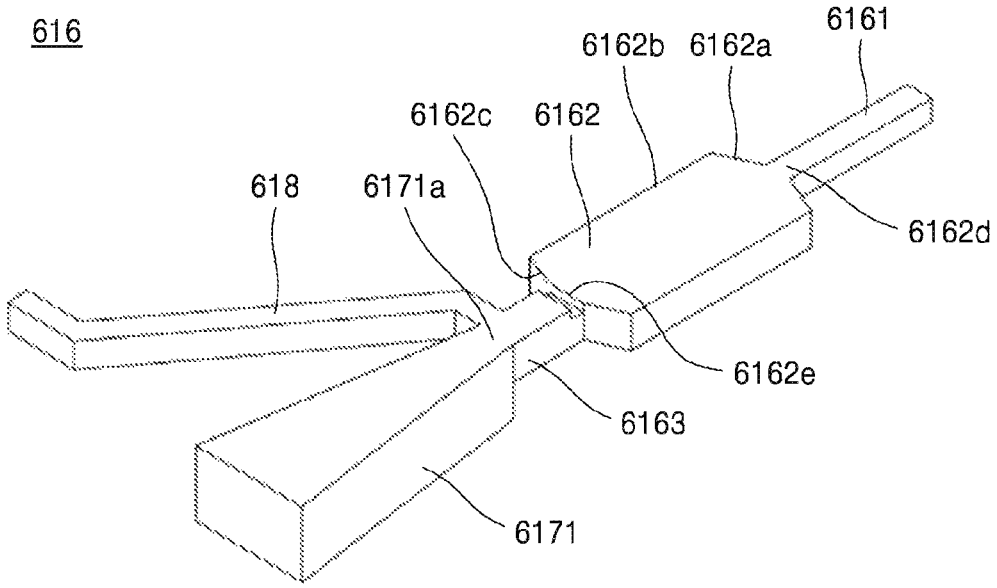
FIG. 9 is a perspective view illustrating an example of a bubble generation flow path and a discharge flow path formed inside the lower spray arm.
Figure 12:
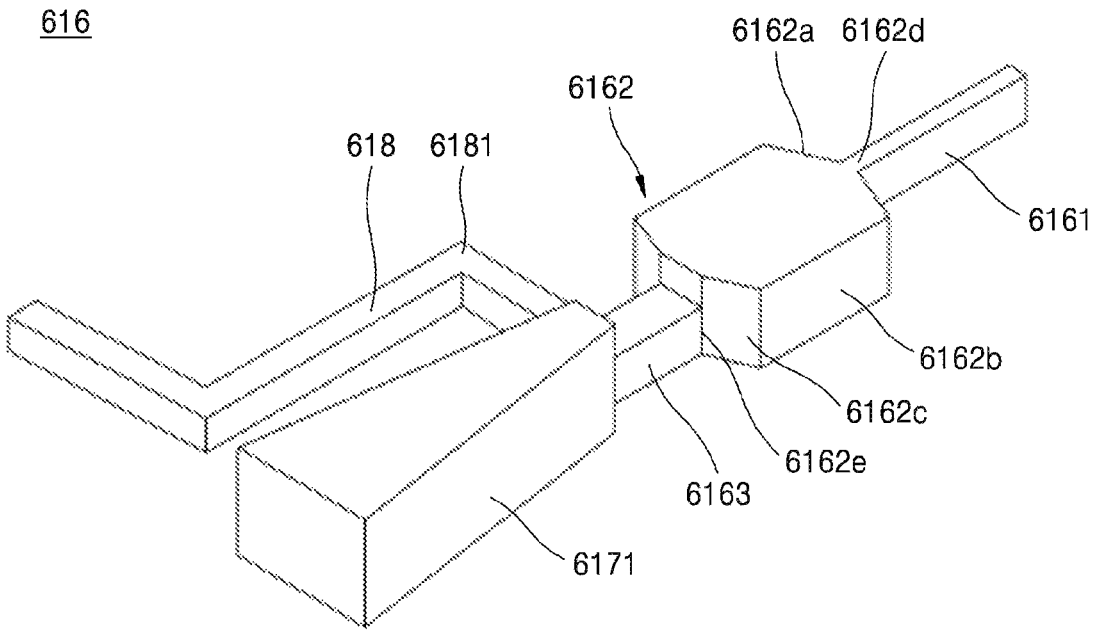
FIG. 12 is a perspective view illustrating another example of the bubble generation flow path and the discharge flow path formed inside the lower spray arm.

FIGS. 9 and 12 exemplarily illustrate the first discharge flow path 6171 having a rectangular flow path cross-section in which the width in the horizontal direction is formed greater than the width in the vertical direction.

In this connection, as illustrated, the size of the flow path cross-sectional area at an inlet end 6171*a* of the first discharge flow path 6171 may be formed greater than the size of the flow path cross-sectional area at a discharge end 6164*b* of the air suction flow path 6163. Illustratively, the size of the flow path cross-sectional area of the inlet end 6171*a* of the first discharge flow path 6171 may be formed to have a size of 1.5 to 2.5 times greater than the size of the flow path cross-sectional area of the discharge end 6164*b* of the air suction flow path 6163. Accordingly, the pressure of the washing water discharged from the air suction flow path 6163 and flowing into the first discharge flow path 6171 may be rapidly increased, and the air contained in the washing water may be secondarily crushed by the pressure of the washing water.

Hereinafter, with reference to FIGS. 15 and 16, the bubble generation flow path 616 having a different flow path cross-sectional shape will be described.

Figure 15:
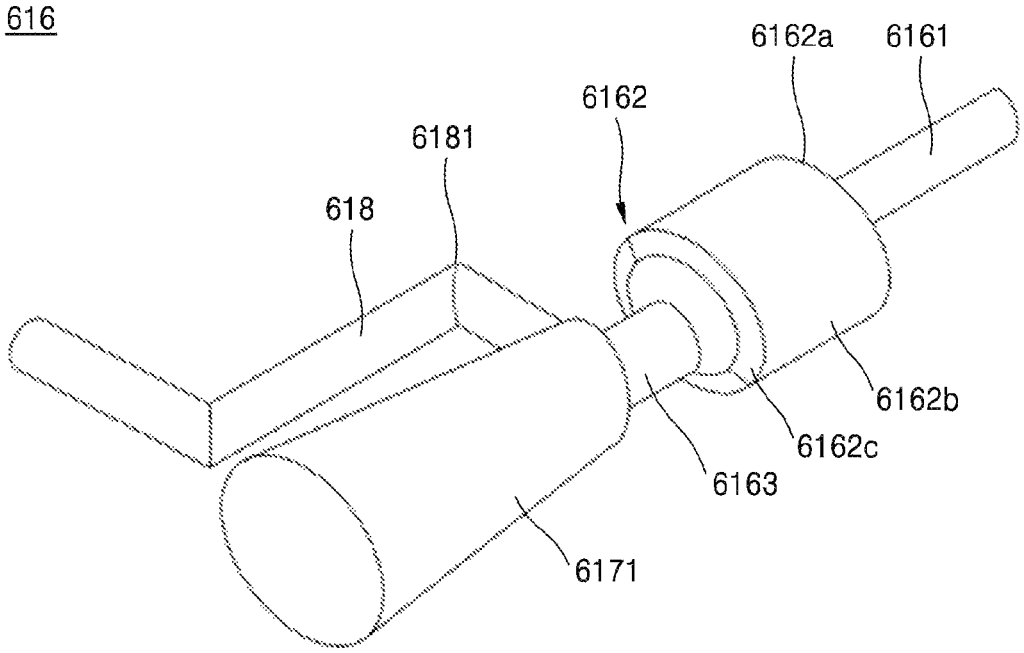
FIG. 15 is a perspective view illustrating another example of the bubble generation flow path and the discharge flow path formed inside the lower spray arm.
Figure 16:
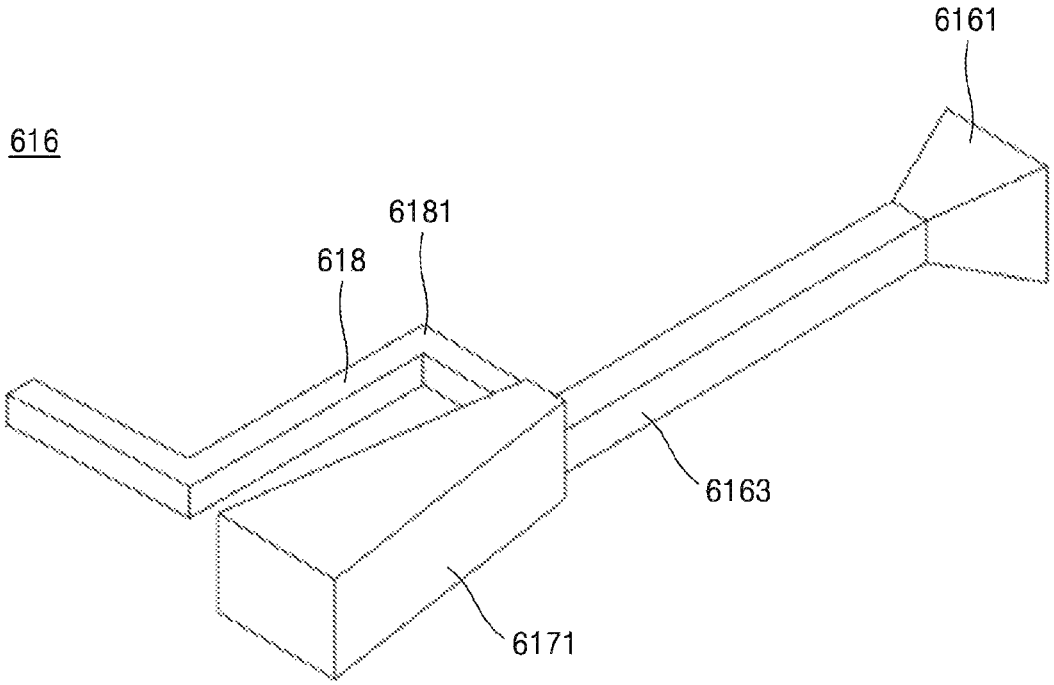
FIG. 16 is a perspective view illustrating another example of the bubble generation flow path and the discharge flow path formed inside the lower spray arm.

First, as illustrated in FIG. 15, the bubble generation flow path 616 may have a cross section of the flow path in a circular or elliptical shape unlike the above configuration.

Accordingly, in the illustrated bubble generation flow path 616, flow loss of washing water may be minimized compared to a configuration in which the cross section of the flow path is square. In particular, vortices generated at angled corners may be minimized.

Figure 14:
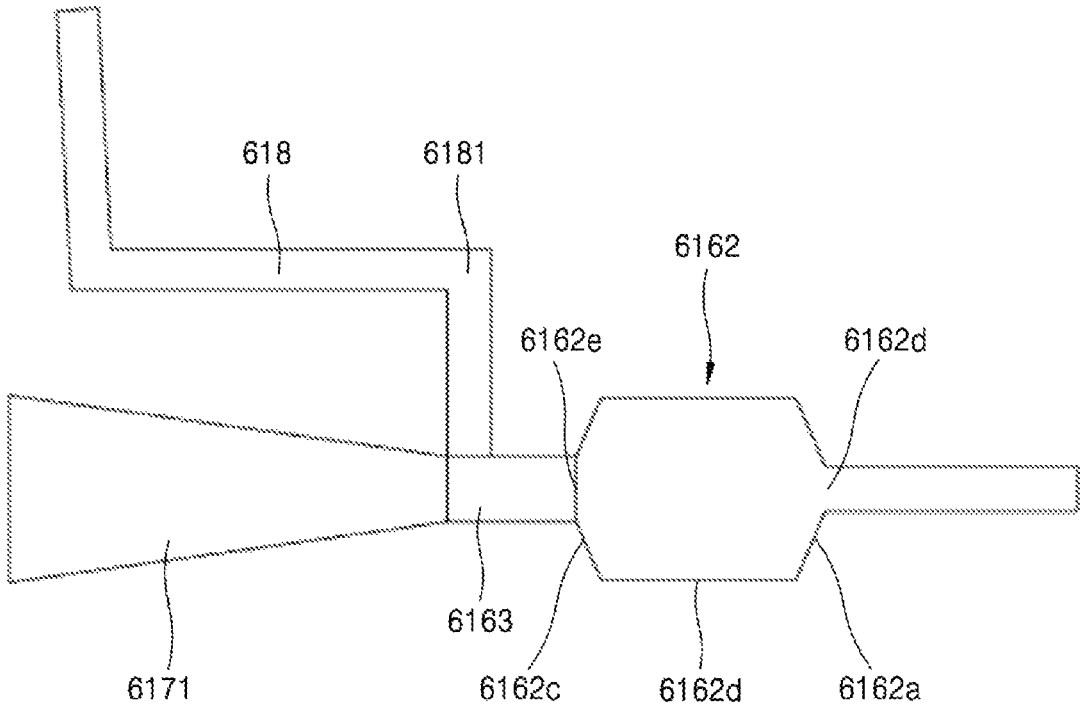
FIG. 14 is a plan view of FIG. 12.

As illustrated in FIG. 14, the bubble generation flow path 616 may not include a separate buffer flow path unlike the aforementioned configurations. However, the connection flow path 6161 may have a form in which the cross-sectional area of the flow path is gradually reduced in order to lower the pressure of the flowing washing water.

As such, the structure of the upper body 610*a* and the lower body 610*b* of the lower spray arm 61 for forming the bubble generation flow path 616 may be simplified by omitting the buffer flow path from the bubble generation flow path 616. Accordingly, the manufacturing cost of the lower spray arm 61 may be reduced.

FIGS. 17 to 20 are cross-sectional views taken along a X-X' direction shown in FIG. 8, that is, in a direction perpendicular to the extension direction of the connection flow path 6161.

Hereinafter, referring to FIGS. 17 to 20, a structure in which the internal flow path through which washing water flows is formed inside the lower spray arm 61 will be described.

As described above, at least one of the upper body 610*a* or the lower body 610*b* may be provided with the fusion rib 610*a*3 for coupling and fastening the upper body 610*a* or the lower body 610*b* to each other.

Referring to the illustrated embodiment, the fusion rib 610*a*3 may be provided on the inner bottom surface 610*a*1 of the upper body 610*a*. The fusion rib 610*a*3 may have a barrier form having one end integrally connected to the inner bottom surface 610*a*1 of the upper body 610*a* and the other end extending toward the upper surface 610*b*1 of the lower body 610*b*. Accordingly, during injection molding of the upper body 610*a*, the fusion rib 610*a*3 may be formed integrally with the upper body 610*a* together with the upper body 610*a*.

In this connection, in order to provide uniform coupling force between the upper body 610*a* and the lower body 610*b*, the fusion rib 610*a*3 may be continuously formed along an outer edge of the inner bottom surface 610*a*1 in a state of being spaced apart from the outer edge of the inner bottom surface 610*a*1 of the upper body 610*a* toward the inside at a predetermined interval.

In addition, the fusion rib 610*a*3 may serve to protect the flow path forming ribs 610*a*4 and 610*b*4 forming an internal flow path through which washing water flows. In order to effectively protect the flow path forming ribs 610*a*4 and 610*b*4, the fusion rib 610*a*3 may extend from an outer side of the flow path forming ribs 610*a*4 and 610*b*4 to entirely surround the flow path forming ribs 610*a*4 and 610*b*4.

As illustrated in FIGS. 17 to 20, the flow path forming ribs 610*a*4 and 610*b*4 may be protected in a sealed state inside the fusion rib 610*a*3 in a form surrounded by the fusion rib 610*a*3.

As illustrated in FIG. 15, in order to minimize interference with the flow path forming ribs 610*a*4 and 610*b*4 provided on an inner side of the fusion rib 610*a*3, the interval between the fusion rib 610*a*3 and the flow path forming rib 610*a*4 and 610*b*4 may be maintained substantially constant while proceeding along a length direction of the fusion rib 610*a*3.

The lower end of the fused rib 610*a*3 may be firmly fixed to the upper surface 610*b*1 of the lower body 610*b* by being fused to the upper surface 610*b*1 of the lower body 610*b* by ultrasonic vibration.

FIGS. 17 to 20 illustrate that the lower end of the fusion rib 610*a*3 is inserted into the lower body 610*b*, but are only illustrated to intuitively recognize that the protruding height of the fusion rib 610*a*3 may be formed so that the fusion coupling may occur effectively. When actual fusion occurs, the lower end of the fusion rib 610*a*3 and the upper surface 610*b*1 of the lower body 610*b* are melted together to form a fusion portion 610*a*4. In other words, the lower end of the fused rib 610*a*3 inserted through the upper surface 610*b*1 of the lower body 610*b* functions as a portion of the fusion portion 610*a*4.

A configuration related to coupling and fastening of the fusion rib 610*a*3 and the lower body 610*b* using ultrasonic vibration may be applied to a configuration presently known in the art, so description of the detailed configuration will be omitted.

As described above, on an inner side of the fusion rib 610*a*3, the flow path forming rib 610*a*4 and 610*b*4 may be disposed spaced apart from the fusion rib 610*a*3 at a predetermined interval and forming a side surface of a flow path through which washing water flows therein.

The flow path forming ribs 610*a*4 and 610*b*4 may be provided in the form of a pair of barriers or partitions protruding downward from the inner bottom surface 610*a*1 of the upper body 610*a* similarly to the aforementioned fusion rib 610*a*3, or protruding upward from the upper surface 610*b*1 of the lower body 610*b*. Thus, between the pair of flow path forming ribs 610*a*4 and 610*b*4 and the inner bottom surface 610*a*1 of the upper body 610*a* and between the pair of flow path forming ribs 610*a*4 and 610*b*4 and the upper surface 610*b*1 of the lower body 610*b*, a closed space or closed channel acting as a flow path may be formed.

In order to form a channel functioning as a flow path, the flow path forming ribs 610*a*4 and 610*b*4 may be partially provided on either the upper body 610*a* or the lower body 610*b*, or the flow path forming ribs 610*a*4 and 610*b*4 may be partially provided in a form each divided on the upper body 610*a* and the lower body 610*b*.

Hereinafter, among the flow path forming ribs 610*a*4 and 610*b*4, those provided in the upper body 610*a* are referred to as the first flow path forming rib 610*a*4, and those provided in the lower body 610*b* are referred to as the second flow path forming ribs 610*b*4.

FIGS. 17 to 20 illustrate an embodiment in which both sides of the connection flow path 6161 among the flow paths of washing water are formed using only the first flow path forming rib 610*a*4 provided in the upper body 610*a*. Although an embodiment of the present disclosure is not limited thereto, a configuration in which both sides of the connection flow path 6161 are formed using only the first flow path forming rib 610*a*4 will be described below.

As described above, the flow path cross-sectional area of the connection flow path 6161 may be formed smaller than that of other flow paths configuring the bubble generation flow path 616. To this end, both side surfaces of the connection flow path 6161 may be formed only with the first flow path forming rib 610*a*4.

In this connection, in order to reduce the flow path cross-sectional area of the connection flow path 6161, a raised surface 610*b*3 formed as a substantially flat surface corresponding to the first flow path forming rib 610*a*4 on the upper surface 610*b*1 of the lower body 610*b* (610*b*3) may protrude upward from the upper surface 610*b*1. In this connection, the raised surface 610*b*3 functions as a lower side surface of the connection flow path 6161.

As illustrated, the raised surface 610*b*3 may protrude upward from the upper surface 610*b*1 of the lower body 610*b* toward the upper body 610*a*.

Figure 17:
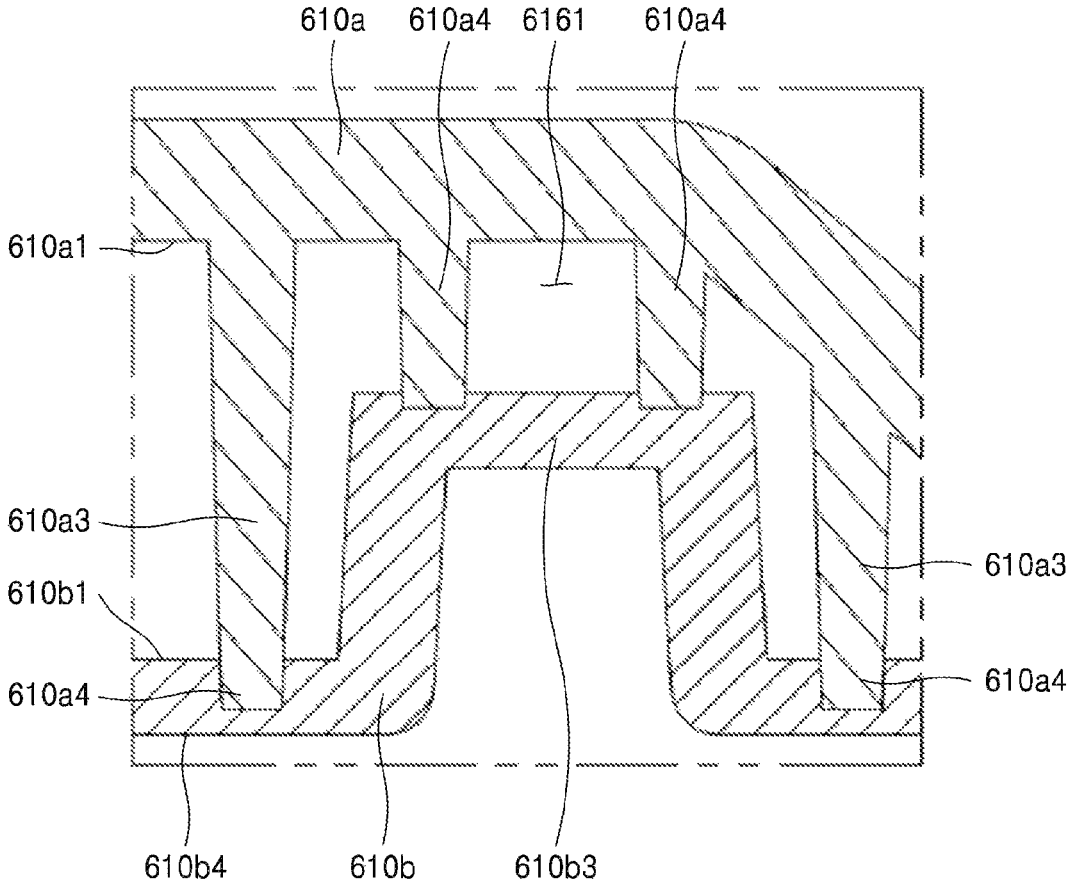
FIGS. 17 to 20 are cross-sectional views taken along a X-X' direction to explain the flow path cross-sectional form and coupling relationship of a connection flow path configuring the bubble generation flow path.

First, referring to FIG. 17, the raised surface 610*b*3 may be formed on the lower body 610*b*, and a pair of first flow path forming ribs 610*a*4 extending toward the raised surface 610*b*3 of the lower body 610*b* may protrude from the upper body 610*a*.

When the upper body 610*a* and the lower body 610*b* are coupled, the lower end of the pair of first flow path forming ribs 610*a*4 may come into contact with the raised surface 610*b*3 of the lower body 610*b*. In a state in which the lower ends of the pair of first flow path forming ribs 610*a*4 come into contact with the raised surface 610*b*3 of the lower body 610*b*, the lower end of the fusion rib 610*a*3 of the upper body 610*a* may be fused to the upper surface 610*b*1 of the lower body 610*b*. Similar to the aforementioned fusion rib, the portion indicated in the drawing that the lower end of the first flow path forming rib 610*a*4 passes through the raised surface 610*b*3 of the lower body 610*b* forms a fusion portion. In this connection, the interval between the pair of first flow path forming ribs 610*a*4 may be, formed smaller than the width of the upper end of the raised surface 610*b*3. In this structure, even when there is some error due to fusion between the upper body 610*a* and the lower body 610*b*, the area of the flow path or the center of the flow path may be maintained without being changed.

Figure 18:
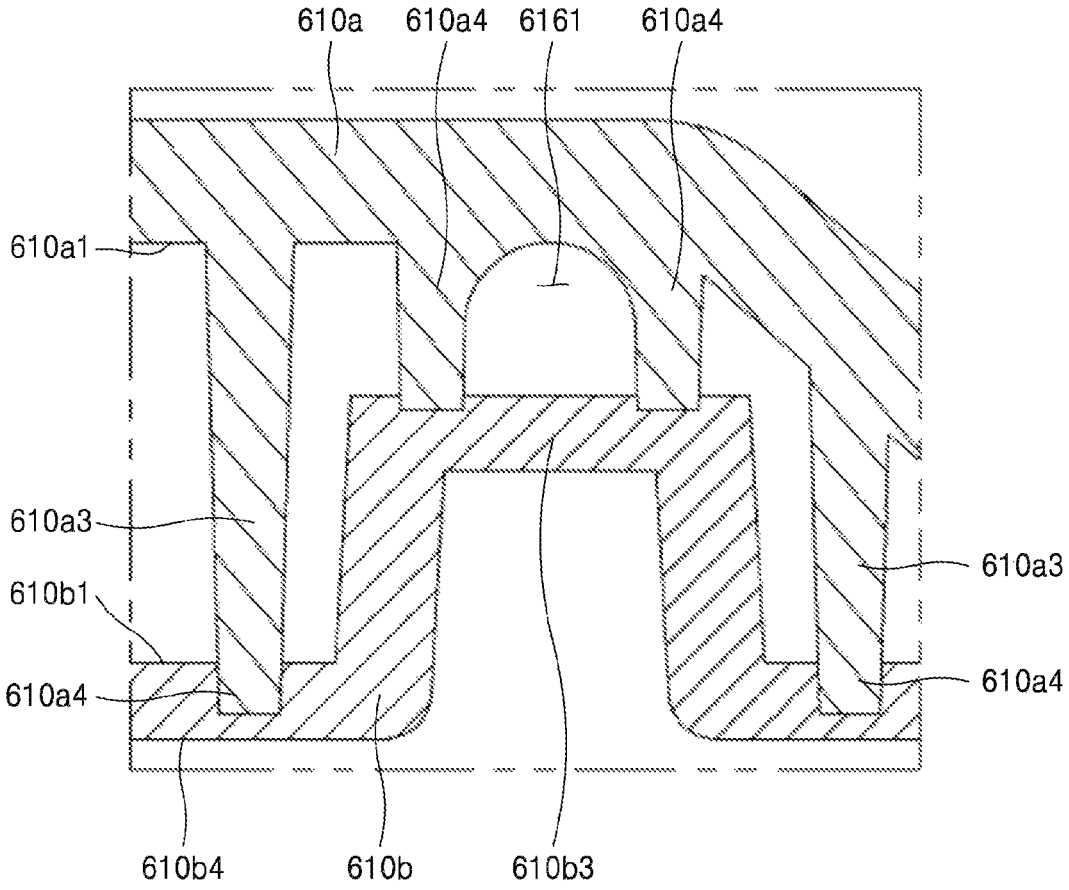
Figure 19:
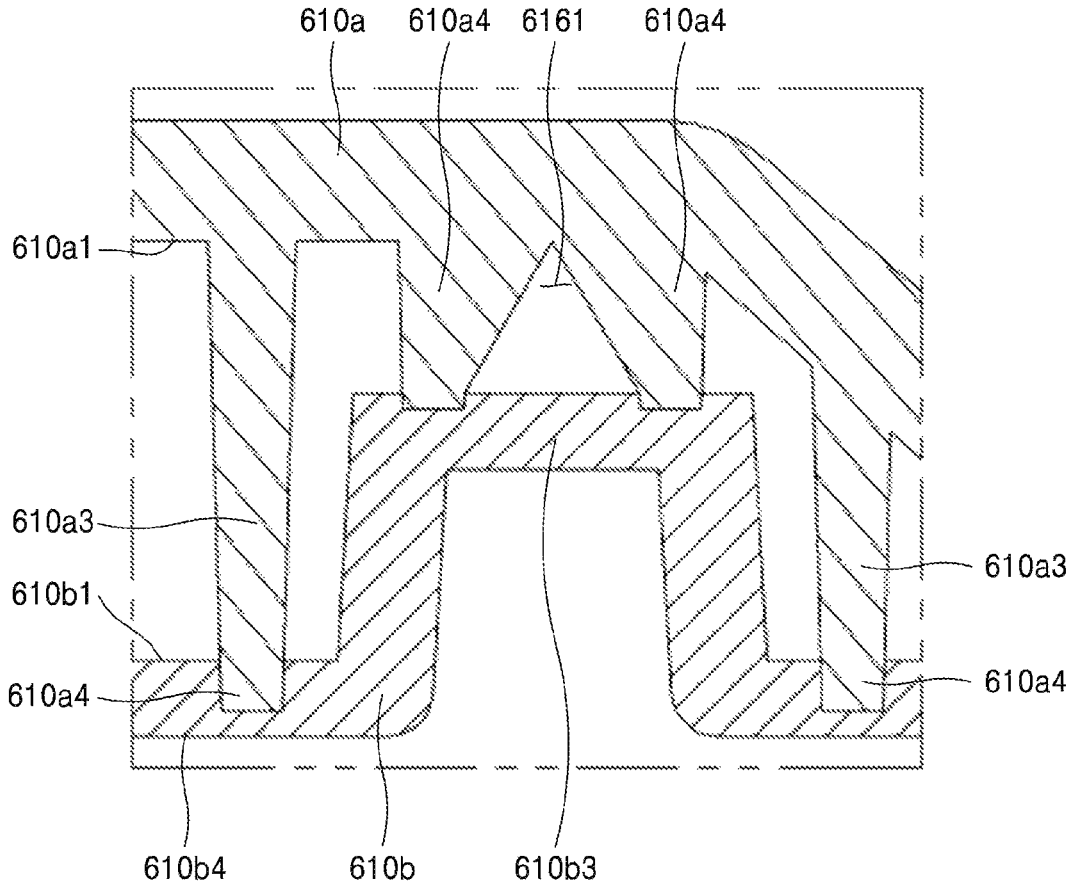
Figure 20:
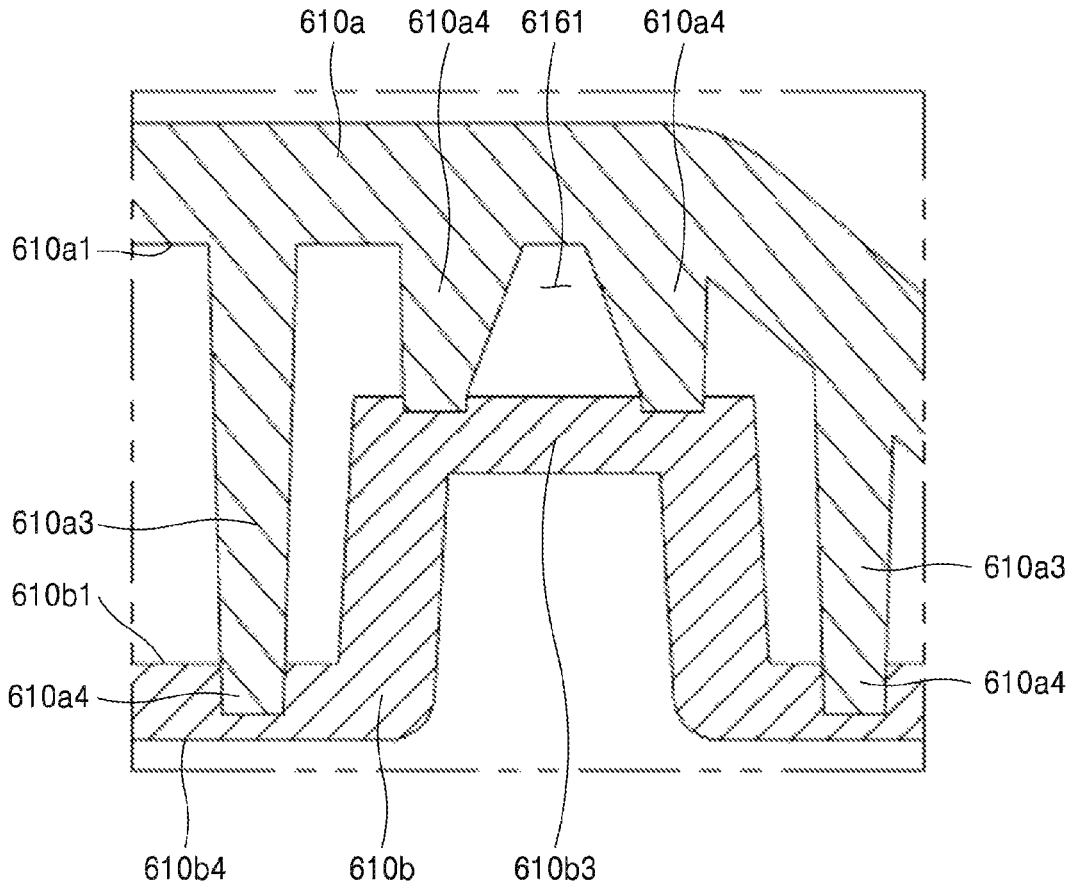

Referring to FIG. 17, the connection flow path 6161 may be a flow path having a substantially square cross section. However, the flow path shape of the square cross section shown in FIG. 17 is merely exemplary. In other words, in order to minimize the formation of vortices at the corner side formed by the meeting of the corners, a semicircular cross-sectional shape as illustrated in FIG. 18, a triangular cross-sectional shape as illustrated in FIG. 19, and a trapezoidal cross-sectional shape as illustrated in FIG. 20 are also applicable.

Although not shown, among the bubble generation flow paths 616, both side surfaces of the buffer flow path 6162, the air suction flow path 6163, and the discharge flow path 617 disposed downstream of the connection flow path 6161 and having a larger cross-sectional area than the connection flow path 6161 may be formed by coupling the first flow path forming rib 610*a*4 and the second flow path forming rib 610*b*4.

[Detailed Configuration of Discharge Flow Path]

Hereinafter, the structure of the discharge flow path 617 and the arrangement of the first discharge hole 623*h* will be described with reference to FIGS. 21 to 29.

As described above, the discharge flow path 617 is configured to be disposed on the downstream side of the air suction flow path 6163 and to be connected to the air suction flow path 6163.

Figure 21:
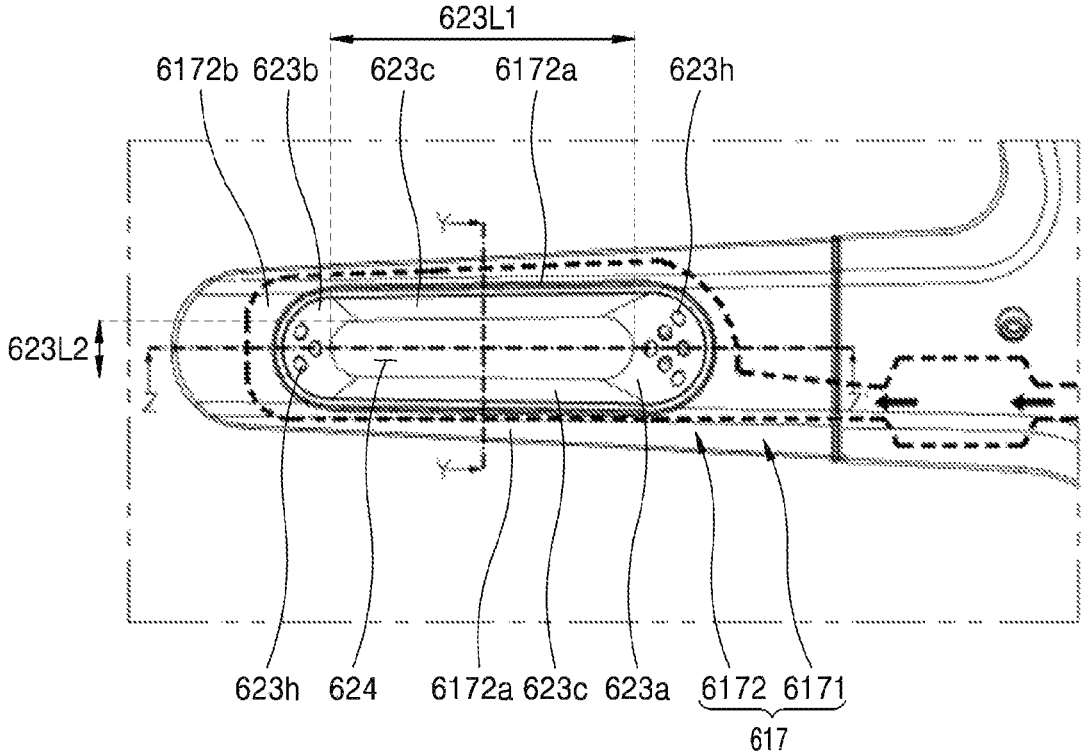
FIG. 21 is a partially enlarged view of part A of FIG. 6.
Figure 22:
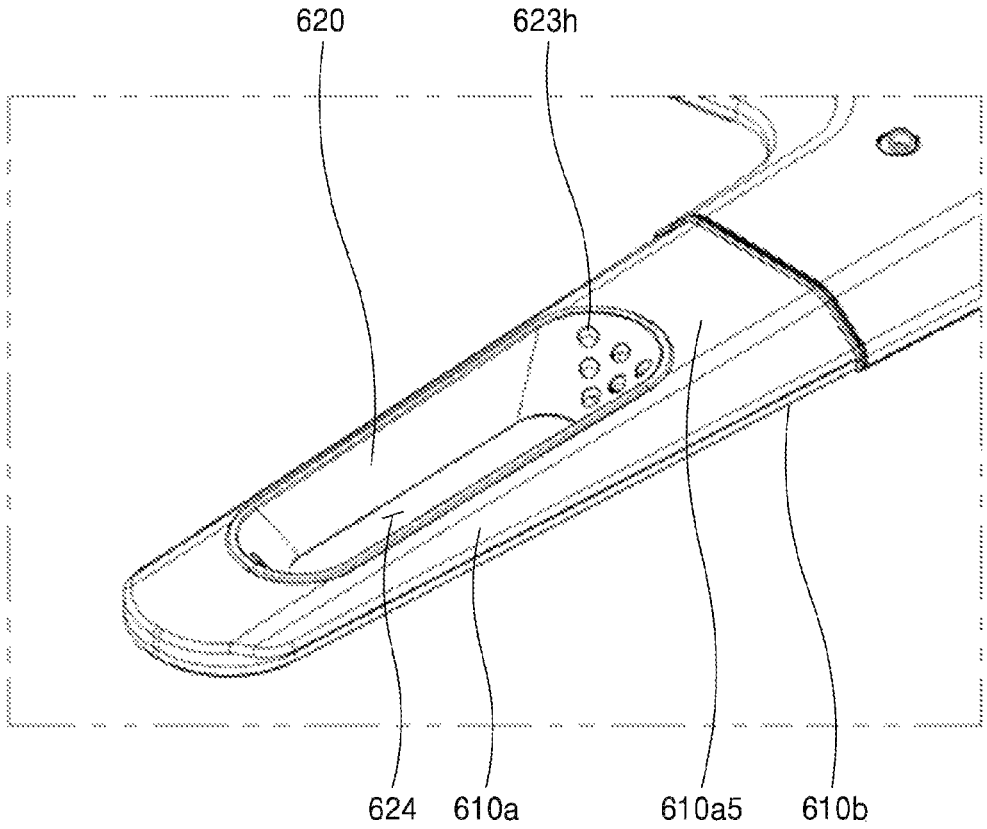
FIG. 22 is a partially enlarged view of part B of FIG. 4.

In more detail, as illustrated in FIG. 21, the discharge flow path 617 may include the first discharge flow path 6171 connected to the air suction flow path 6163 and gradually expanding the flow path, and the second discharge flow path 6172 disposed downstream of the first discharge flow path 6171 and having the discharge holes 617*a*, 617*b*, and 623*h* formed.

All of the above configurations are applicable to the first discharge flow path 6171, and therefore, descriptions of overlapping contents will be omitted.

The second discharge flow path 6172 is formed along the direction in which the second blade 612 extends, and finally discharges the washing water in which microbubbles are generated through the discharge holes 617*a*, 617*b*, and 623*h* formed on one side toward the tub 20.

The second discharge flow path 6172 may be configured such that washing water flowing through the first discharge flow path 6171 is branched or forked.

In more detail, the second discharge flow path 6172 may be branched from the first short side portion 623*a* of the bubble discharge portion 620. Accordingly, the flow of washing water may be temporarily stagnant around the first short side portion 623*a*, and the stagnant washing water may be discharged to the tub 20 through the first discharge hole 623*h* formed in the first short side portion 623*a*. Accordingly, since the bubble discharge portion 620 serves to discharge washing water containing microbubbles, it may be a washing water discharge portion. In addition, since the second discharge flow path 6172 may be branched or forked by the bubble discharge portion 620, the bubble discharge portion 620 may be referred to as a flow path branching portion, and as will be described later, may also be referred to as a coupling hole cover because the bubble discharge portion 620 serves to cover a upper coupling hole 610*a*2 and the lower coupling hole 610*b*2 by being coupled to each of the upper coupling hole 610*a*2 formed in the upper body 610*a* and the lower coupling hole 610*b*2 formed in the lower body.

As illustrated, the second discharge flow path 6172 may be forked into a pair of extension flow paths 6172*a* formed outside the pair of long side portions 623*c*, and the pair of forked extension flow paths 6172*a* may be connected again at the second short side portion 623*b* of the bubble discharge portion 620 to form a confluent flow path 6172*b*.

The pair of extension flow paths 6172*a* may be respectively formed outside the pair of long side portions 623*c*. Each of the pair of extension flow paths 6172*a* may extend linearly along the pair of long side portions 623*c*.

The washing water reaching the confluent flow path 6172*b* may be additionally discharged to the tub 20 through the first discharge hole 623*h* formed in the second short side portion 623*b* of the bubble discharge portion 620.

The bubble discharge portion 620 may be disposed to penetrate the upper body 610*a* and the lower body 610*b* in a vertical direction so as to fork the second discharge flow path 6172.

In more detail, the bubble discharge portion 620 may be disposed to penetrate the 2-1 blade 612*a* and the 2-2 blade 612*b* in a vertical direction where the second discharge flow path 6172 is formed, and a vertical hole 624 opened in the vertical direction may be formed inside the bubble discharge portion 620.

The bubble discharge portion 620 may include the wall portion 623 having a hollow or cylindrical shape to form the vertical hole 624.

In the vertical hole 624, the cross-sectional area of the inner circumferential surface on an upper end side is formed larger than that of the inner circumferential surface on a lower end side. Accordingly, the wall portion 623 of the bubble discharge portion 620 may have a funnel shape that becomes an elliptical column. The bubble discharge portion 620 may have a shape inclined toward an upper side.

The wall portion 623 may include a pair of long side portions 623*c* formed in the direction in which the second blade 612 extends and a pair of short side portions 112*a* and 623*b* (short wall) connecting both ends of the pair of long side portions 623*c*. A funnel-shaped continuous surface may be formed by connecting the pair of long side portions 623*c* to the pair of long side portions 623*c*.

The pair of short side portions 623*a* and 623*b* may include a first short side portion 623*a* disposed adjacent to the side of the air suction flow path 6163 and a second short side portion 623*b* disposed adjacent to an end side of the second blade 612. For example, each of the long side portions 623*c* may have a flat surface form, and each of the short side portions 623*a* and 623*b* may have a curved surface form.

For example, a plurality of first discharge holes 623*h* through which washing water containing microbubbles is discharged may be provided at each of the short side portions 623*a* and 623*b*.

In this connection, an inclination angle θ1 formed by the short side portions 623*a* and 623*b* where the first discharge hole 623*h* is formed with a virtual horizontal line v1 may be formed smaller than an inclination angle θ2 formed by the long side portion 623*c* with the virtual horizontal line v1. Accordingly, the short side portions 623*a* and 623*b* where the plurality of first discharge holes 623*h* are formed may form an inclined surface inclined upward more than the long side portion 623*c*.

A length 623L1 of the long side portion 623*c* formed in a direction in which the second blade 612 extends may be formed longer than a length 623L2 of the short side portions 623*a* and 623*b* formed in a direction perpendicular to the long side portion 623*c*.

Figure 25:
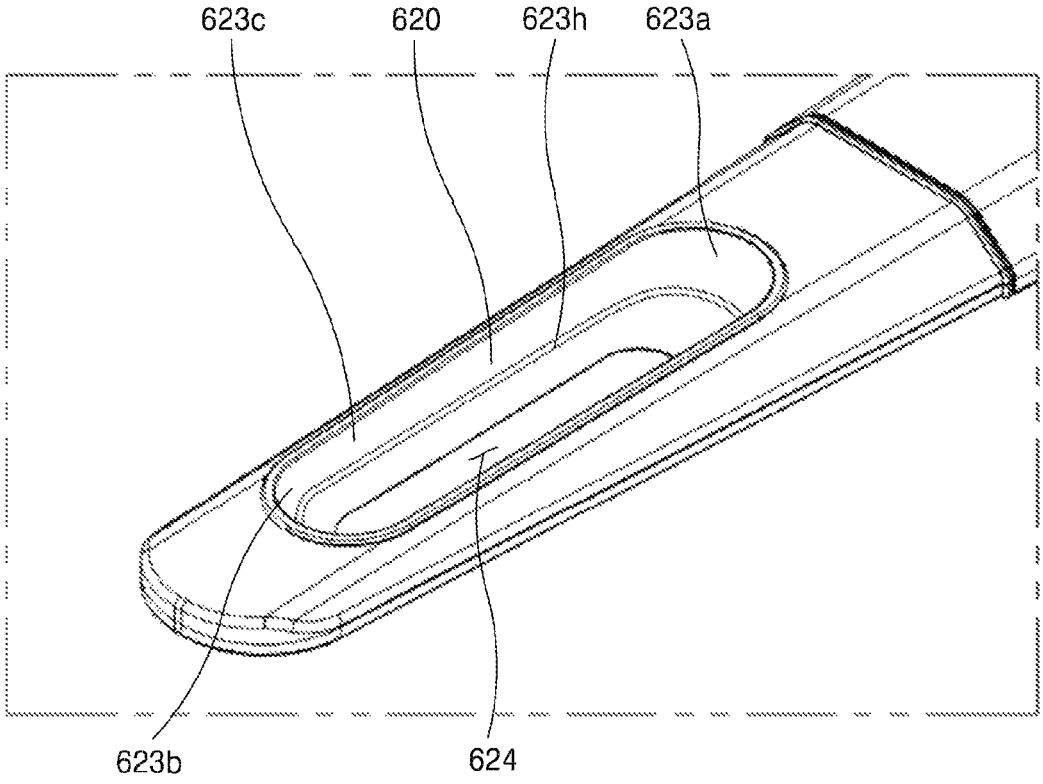
FIGS. 25 and 26 are perspective views of a second blade provided with a different form of a discharge hole.

Unlike the above configuration, the first discharge hole 623*h* may be continuously formed along the inner circumferential surface of the bubble discharge portion 620. In other words, as illustrated in FIG. 25, the first discharge hole 623*h* may be formed in a slit form at each of the short side portions 623*a* and 623*b* and the long side portion 623*c* of the bubble discharge portion 620.

Figure 26:
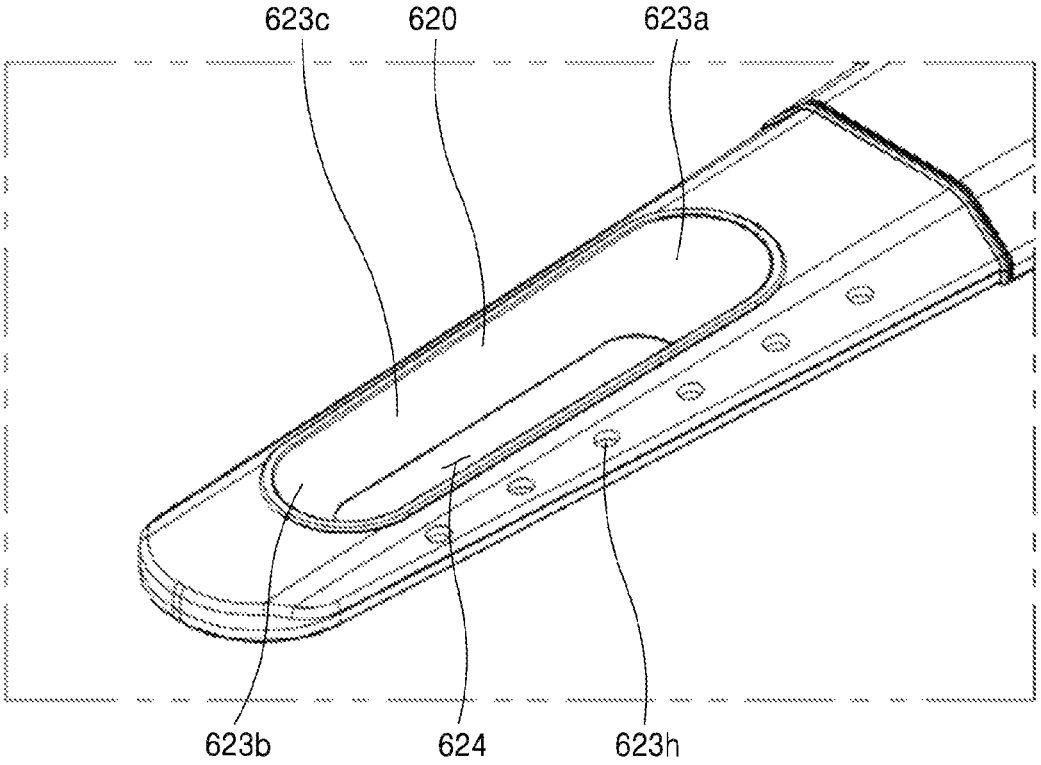

In addition, referring to FIG. 26, the first discharge hole 623*h* may also be formed in the upper body 610*a*. In this connection, the plurality of first discharge holes 623*h* may be disposed to be spaced apart from each other in a direction in which the second blade 612 extends.

Unlike the above configuration, the bubble generation flow path 616 may also be formed around an outer circumference of the bubble discharge portion 620.

Figure 27:
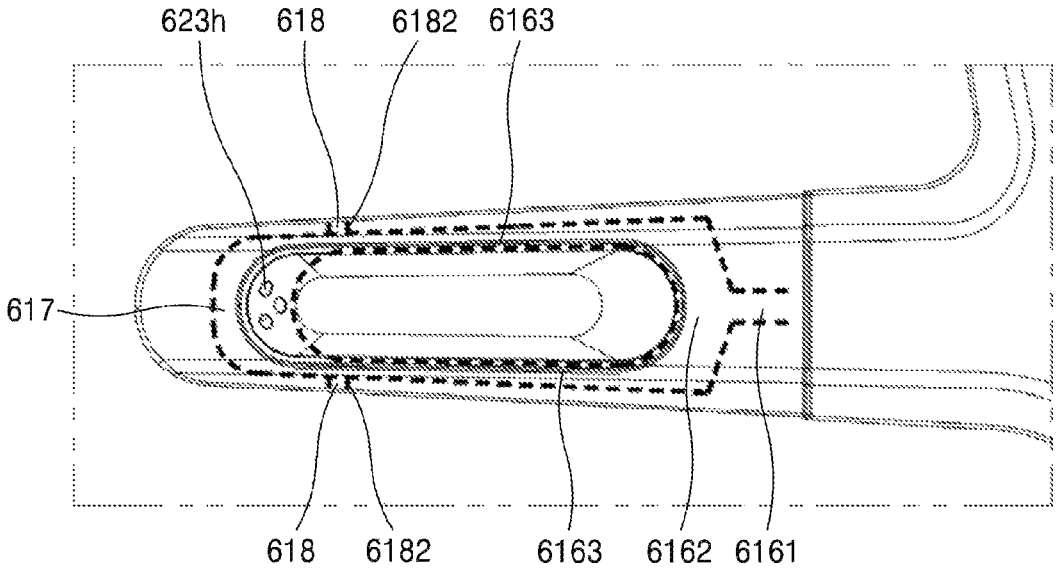
FIG. 27 is a partially enlarged view for explaining another example of the bubble generation flow path and the discharge flow path formed inside the lower spray arm.

In other words, as illustrated in FIG. 27, the bubble generation flow path 616 may include: the connection flow path 6161 connected to the hub 613; a buffer flow path 6162 connected to the connection flow path 6161 and being contracted after the cross-sectional area of the flow path is increased; an air suction flow path 6164*b* connected to the buffer flow path 6162 and retaining the contracted cross-sectional area of the flow path; and the discharge flow path 617 connected to the air suction flow path 6164*b* and expanding the cross-sectional area of the flow path, and discharging washing water to the discharge hole 623*h*. The bubble generation flow path 616 excluding the connection flow path 6161 may be disposed in a form of surrounding the bubble discharge portion 620 around the bubble discharge portion 620.

In addition, the bubble generation flow path 616 may include a pair of air suction flow paths 6163. Each of the pair of air suction flow paths 6163 may be connected to a pair of air flow passages 618 in which external air is flowed. The pair of air flow passages 618 supply external air inflowed from the pair of suction holes 6182 formed on one side to the pair of air suction flow paths 6163, respectively.

The buffer flow path 6162 may be connected to each of the pair of air suction flow paths 6163. In other words, the washing water flowed into the buffer flow path 6162 may flow into the pair of air suction flow paths 6163.

In addition, the connection flow path 6161 may be connected to the buffer flow path 6162 at the center of the second blade 612 in a width direction. The pair of air suction flow paths 6163 may be connected at both ends of the buffer flow path 6162 in the width direction. In other words, the centers of the inlet and outlet of the buffer flow path 6162 may be spaced apart from each other in the width direction of the second blade 612.

[Insert Injection]

As described above, the bubble discharge portion 620 may be formed separately from the upper body 610*a* and coupled to the upper body 610*a*.

In this connection, the separately manufactured bubble discharge portion 620 may be coupled to the upper body 610*a* by an insert injection method.

More specifically, the upper end of the separately provided bubble discharge portion 620 may be fixed to the upper body 610*a* by an insert injection method, and the lower end may be coupled to the upper body 610*a* and the lower body 610*b* in a way that is simply inserted into the lower coupling hole 610*b*2 of the lower body 610*b*.

As a member acting as a coupling portion to the upper body 610*a* during insert injection, a flange portion 625 may be provided in the bubble discharge portion 620.

Figure 24:
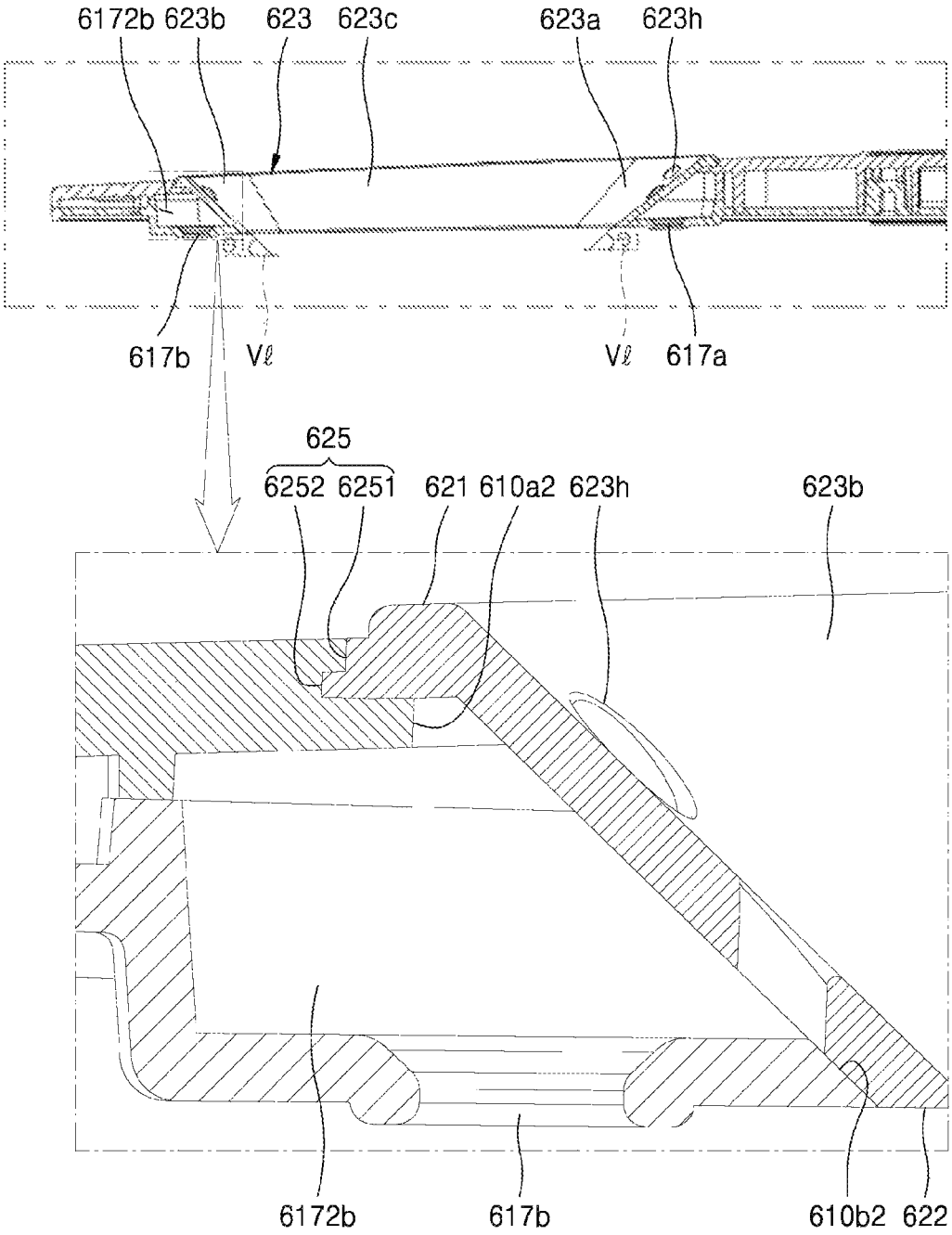
FIG. 24 is a cross-sectional view taken along line Z-Z' illustrated in FIG. 21.

As illustrated in FIG. 24, the flange portion 625 may be disposed close to an upper end 621 of the wall portion 623, and along a direction parallel to the upper side of the upper body 610*a*, the flange portion 625 may be formed to protrude from an outer side surface of the wall portion 623.

In this connection, the flange portion 625 may be continuously formed along the upper end 621 of the wall portion 623 to surround the wall portion 623. As such, by continuously forming the flange portion 625, the effect of reinforcing the rigidity of the bubble discharge portion 620 may be obtained.

The flange portion 625 may become a fixed end integrally connected to the outer side surface of the wall portion 623 at its inner end, and the outer end may become a free end at least partially embedded in the upper body 610*a* during insert injection.

In this connection, the flange portion 625 may include a main flange 6251 exemplarily formed to protrude from an outer side surface of the wall portion 623 in a direction away from an inclined surface 623 and exposed to the outside of the upper body 610*a*, and a sub-flange 6252 formed to protrude from an outer end of the main flange in a direction away from the main flange 6251.

As illustrated in FIG. 24, the main flange 6251 may be embedded in the upper body 610*a* at the time of insert injection, and at least the upper side surface may be exposed so as not to be embedded.

As such, the upper side surface of the main flange 6251 is exposed to the outside of the upper body 610*a*, so that the outer side surface of the wall portion 623 of the bubble discharge portion 620 and an upper side surface 610*a*4 of the upper body 610*a* may be separated from each other.

As described above, during insert injection, the bubble discharge portion 620 is disposed inside a mold of the upper body 610*a* in a state in which molding has been completed in advance. In this connection, the upper end 621 of the bubble discharge portion 620 is directly exposed to the injection pressure. Accordingly, the injection pressure directly acts on the wall portion 623 at the upper end 621 side of the bubble discharge portion 620, and deformation of the wall portion 623 may occur due to the injection pressure. Due to the deformation of the wall portion 623, a predetermined gap may occur between the wall portion 623 and the mold, and burring due to the gap is highly likely to occur.

However, as illustrated, the wall portion 623 of the bubble discharge portion 620 and the upper side surface 610*a*4 of the upper body 610*a* may be separated from each other, and a continuous surface may be formed between the upper side surface 610*a*4 of the upper body 610*a* and the upper side surface of the main flange 6251. Thereby, during insert injection, injection pressure for molding the upper body 610*a* may not directly act on the wall portion 623.

The sub-flange 6252 may protrude from an outer end of the main flange 6251 along a direction away from the main flange 6251.

The sub-flange 6252 may be entirely embedded in the upper body 610*a* at the time of insert injection. The sub-flange 6252 may be formed smaller in thickness in a vertical direction than the main flange 6251 so as to be entirely embedded.

As illustrated in FIG. 24, the upper, outer, and lower side surfaces of the sub-flange 6252 are all embedded by the upper body 610*a*. Accordingly, even when a situation occurs in which external force acts on the bubble discharge portion 620 in a vertical direction, an escape of the bubble discharge portion 620 may be effectively prevented. In other words, the upper and lower side surfaces of the sub-flange 6252 may act as a stopper preventing escape from the upper body 610*a*.

In a state where the coupling between the bubble discharge portion 620 and the upper body 610*a* is completed through the insert injection method in this way, the lower body 610*b* may be coupled to a lower side of the upper body 610*a* through the aforementioned fusion method. In this connection, a lower end 622 of the wall portion 623 configuring the bubble discharge portion 620 may be forcibly inserted or press-fitted into the lower coupling hole 610*b*2 formed in the lower body 610*b*.

Accordingly, the upper end 621 side of the wall portion 623 may be coupled to the upper coupling hole 610*a*2 formed in the upper body 610*a*, so that the upper coupling hole 610*a*2 may remain sealed. The lower end 622 side of the wall portion 623 may be coupled to the lower coupling hole 610*b*2 formed in the lower body 610*b* to maintain a closed state. Thus, leakage between the upper body 610*a* and the wall portion 623 and between the lower body 610*b* and the wall portion 623 may be minimized, and the washing water on the second discharge flow path 6172 may be discharged to an outside of the lower spray arm 61 only through the first discharge hole 623*h* and the second discharge holes 617*a* and 617*b*, as will be described later.

As described above, some of the washing water in which microbubbles are generated is discharged through the first discharge hole 623*h* formed in the wall portion 623 of the bubble discharge portion 620, and the remaining portion is discharged through the second discharge holes 617*a* and 617*b* formed in the lower body 610*b*. The second discharge holes 617*a* and 617*b* serve as a member for increasing the drainage of washing water, which may be insufficient only with the first discharge hole 623*h*.

Figure 28:
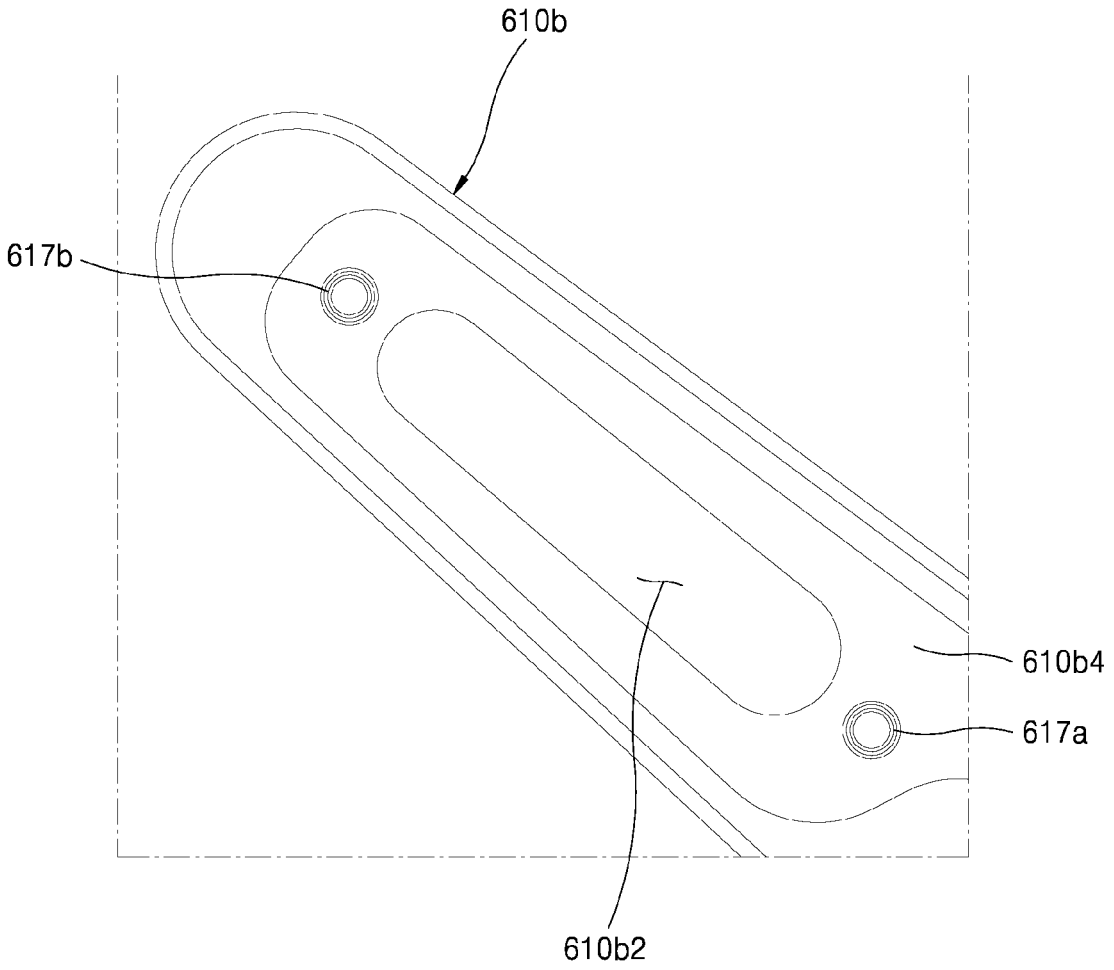
FIGS. 28 and 29 are partially enlarged views of a lower cover for explaining the relationship between a second discharge hole and a lower end coupling hole.

First, as illustrated in FIG. 28, the second discharge holes 617*a* and 617*b* may be formed as circular openings penetrating the lower body 610*b* in a vertical direction, and may be provided as a pair.

For example, the pair of second discharge holes 617*a* and 617*b* may be disposed around the lower coupling hole 610*b*2 while being separated from the lower coupling hole 610*b*2.

In this connection, one of the pair of second discharge holes 617*a* and 617*b* may be disposed inside the lower coupling hole 610*b*2 in a more centrifugal direction than the inner end as a periphery of the inner end. The other of the pair of second discharge holes 617*a* and 617*b* may be disposed outside the lower coupling hole 610*b*2 in a more centrifugal direction than the outer end as a periphery of the outer end.

As such, the position where each of the second discharge holes 617*a* and 617*b* are formed may be a portion of the second discharge flow path 6172 having a relatively large flow path cross-sectional area and a large flow of washing water. In other words, the positions where the second discharge holes 617*a* and 617*b* are formed may be a lower portion of the first short side portion 623*a* of the bubble discharge portion 620, which is the lower portion of the point where the second discharge flow path 6172 is branched, and a lower portion of the second short side portion 623*b* of the bubble discharge portion 620, which is the lower portion of the confluent flow path 6172*b* of the second discharge flow path 6172.

Figure 29:
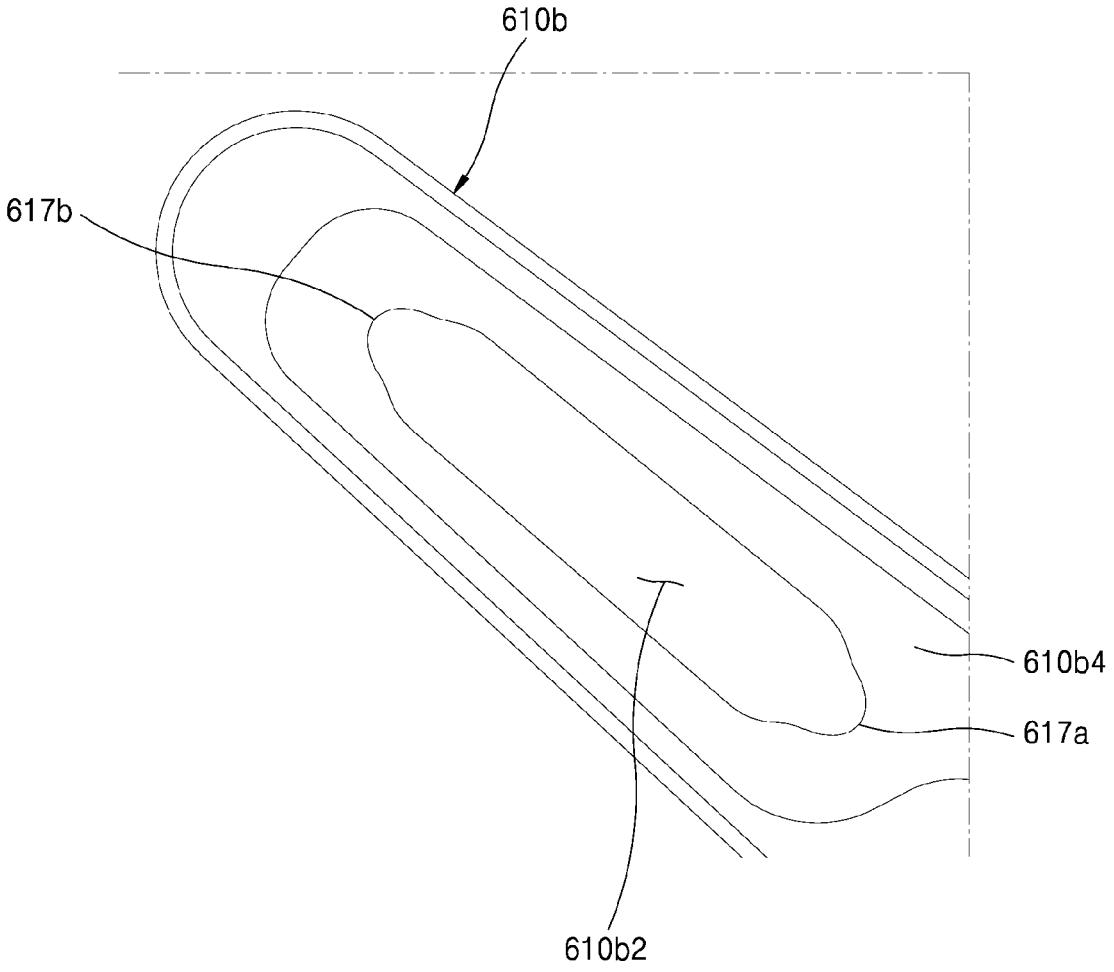

Unlike the configuration illustrated in FIG. 28, as illustrated in FIG. 29, a pair of second discharge holes 617*a* and 617*b* may be disposed to be connected to the lower coupling hole 610*b*2.

As described above, the lower body 610*b* may be configured to be coupled to the lower portion of the upper body 610*a* after the bubble discharge portion 620 and the upper body 610*a* are coupled through insert injection.

In this connection, the lower end 622 of the wall portion 623 of the bubble discharge portion 620 may be coupled while being inserted into the lower coupling hole 610*b*2 penetrating the lower body 610*b*. As illustrated in the lower coupling hole 610*b*2 corresponding to the shape of the outer side surface of the wall portion 623 of the bubble discharge portion 620, the inner and outer ends are provided in the form of a long hole having a curved shape with a predetermined curvature.

However, while the coupling between the upper body 610*a* and the lower body 610*b* is in progress, in a state where the lower end 622 is inserted into the lower coupling hole 610*b*2, the bubble discharge portion 620 moves relatively downward as a whole.

However, since the lower end 622 is relatively moved in the inserted state, the stress acting on the wall portion 623 of the funnel-shaped bubble discharge portion 620 gradually increases. In particular, a phenomenon in which stress is concentrated on the first short side portion 623*a* and the second short side portion 623*b* of the wall portion 623 may occur. There is a high possibility that deformation occurs in the first short side portion 623*a* and the second short side portion 623*b* due to such stress concentration.

As such, in order to minimize the deformation of the first short side portion 623*a* and the second short side portion 623*b* due to stress concentration by contact between the inner end of the lower coupling hole 610*b*2 and the first short side portion 623*a* of the wall portion 623 and contact between the outer end of the lower coupling hole 610*b*2 and the second short side portion of the wall portion 623, the second discharge holes 617*a* and 617*b* may be configured to be connected to the lower coupling hole 610*b*2.

As illustrated in FIG. 29, the second discharge holes 617*a* and 617*b* may be connected to each of the inner and outer ends of the lower coupling hole 610*b*2 to form a single through hole.

However, in order to prevent an excessive increase in the drainage of washing water through the second discharge holes 617*a* and 617*b*, the curvature of the second discharge holes 617*a* and 617*b* may be formed smaller than the curvature of the inner and outer ends of the lower coupling hole 610*b*2.

As such, the second discharge holes 617*a* and 617*b* are connected to the lower coupling hole 610*b*2 to form a single through hole, so that contact between the lower coupling hole 610*b*2 and the first short side portion 623*a* and contact between the lower coupling hole 610*b*2 and the second short side portion 623*b* can be minimized, and thus a stress concentration phenomenon on the first short side portion 623*a* and the second short side portion 623*b* may be resolved.

The lower spray arm 61 according to an embodiment of the present disclosure further includes a deco cover 630 disposed at an upper side of the main body portion 610 and at least partially covering the upper side surface 610*a*4 of the main body portion 610.

FIGS. 30 to 33 exemplarily illustrate a configuration in which the deco cover 630 entirely covers the upper side surface of the first blades 611*a* and 611*b* and partially covers the upper side surface of the second blades 612*a* and 612*b*. An embodiment of the present disclosure is not limited thereto, but will be described based on the illustrated configuration by way of example.

The deco cover 630 serves to prevent the main body portion 610 of the lower spray arm 61 from being broken or damaged when an object to be washed is detached from the storage portion 50 and falls during or after the process of the dishwasher 1.

Accordingly, the deco cover 630 may be manufactured through press working with a material having higher rigidity than the main body portion 610, for example, a metal plate.

Preferably, the decor cover 630 may be formed of a stainless steel-based material having sufficient rigidity and corrosion resistance.

However, in order to minimize the increase in weight due to the addition of the decor cover 630, a plate material having a substantially uniform thickness may be used.

Figure 30:
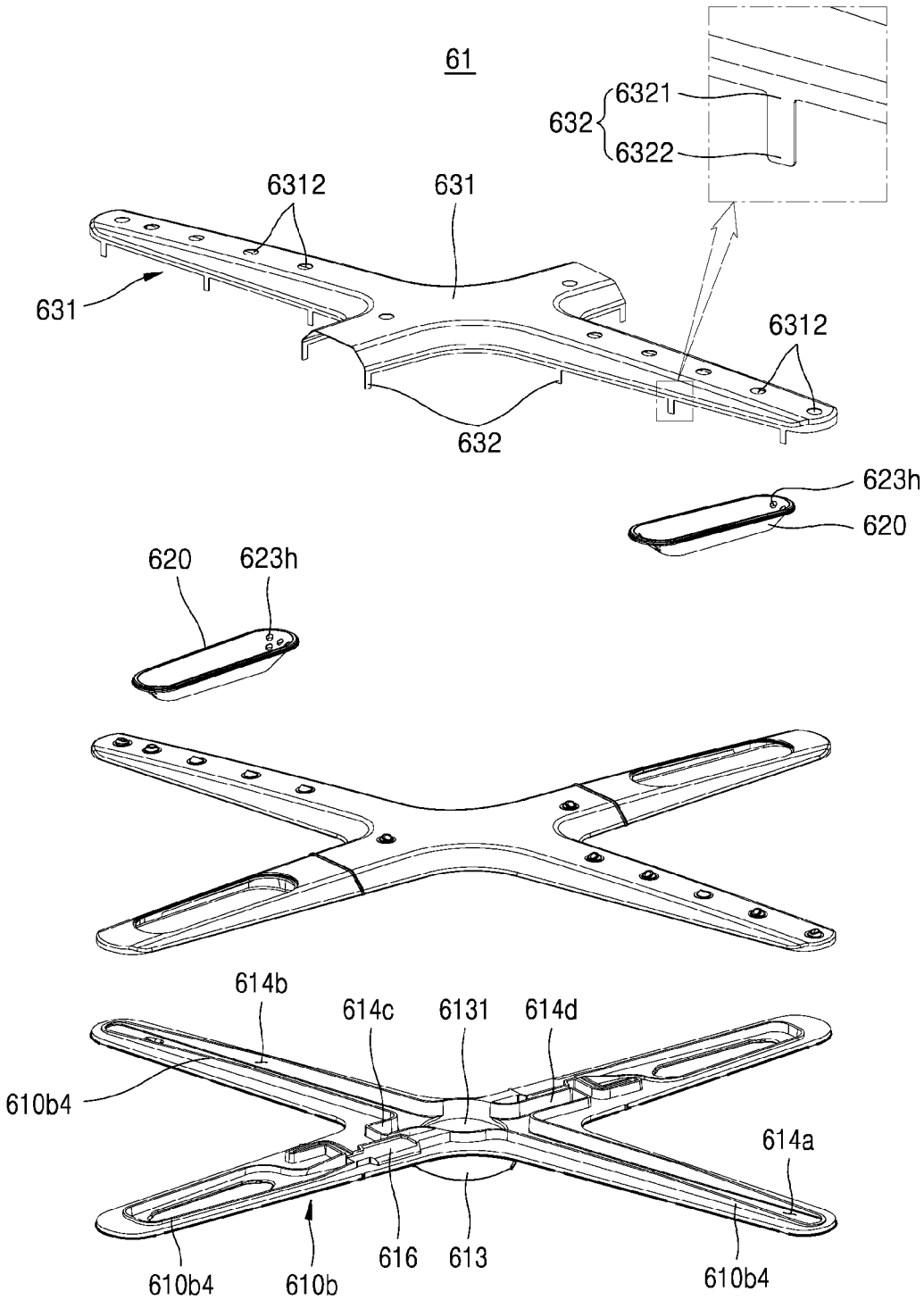
FIG. 30 is an exploded perspective view of the lower spray arm further including a deco cover according to another embodiment of the present disclosure.

As illustrated in FIG. 30, the deco cover 630 may include a cover main body 631 that entirely covers an upper side surface and a side surface of the first blades 611*a* and 611*b* and partially covers the upper side surface and the side surface of the second blades 612*a* and 612*b*. To this end, the cover main body 631 may be formed to have a shape corresponding to the shape of an upper outer surface of the upper body 610*a*.

In this connection, the cover main body 631 may be configured to cover only up to an intermediate point along a longitudinal direction of the second blades 612*a* and 612*b*. Based on the illustrated configuration, the cover main body 631 may be configured to cover a position between the rotational center 61*c* and the bubble discharge portion 620 to minimize interference with the bubble discharge portion 620.

The upper side surface 6311 of the cover body 631 may be provided with a plurality of through holes 6312 formed at positions corresponding to the positions of the spray nozzles 615*a* and 615*b* and the additional spray nozzles 615*c* and 615*d* so that the spray nozzles 615*a* and 615*b* and the additional spray nozzles 615*c* and 615*d* may pass therethrough.

The deco cover 630 may further include a plurality of fastening tabs 632 extending downward from a lower edge of the cover main body 631.

The plurality of fastening tabs 632 serve to provide coupling force for fastening between the cover main body 631 and the main body portion 610 of the lower spray arm 61 by plastic deformation.

As illustrated, each fastening tab 632 may be configured so that one end 6312 becomes a fixed end integrally connected to the lower edge of the cover main body 631 and the other end 6322 becomes a free end.

Accordingly, the other end 6322 side of each fastening tab 632 is bent toward the lower surface of the main body portion 610, that is, the lower surface 610*b*4 of the lower body 610*b*, so that the deco cover 630 may be fastened to the main body portion 610 in a plastic deformation manner.

In order to easily perform plastic deformation of the fastening tab 632, the vertically extended length of the fastening tab 632 may be formed much larger than the width in the horizontal direction.

Accordingly, the other end portion 6322 side of the fastening tab 632 may be smoothly bent in a direction perpendicular to a longitudinal direction.

However, when the fastening using the plurality of fastening tabs 632 is completed, the other end 6322 side of the fastening tab 632 bent toward the lower surface 610*b*4 of the lower body 610*b* of the main body portion 610 remains exposed to the washing space 21 of the tub 20.

However, even when it is bent toward the lower surface 610*b*4 of the lower body 610*b* as much as possible, the other end 6322 of the fastening tab 632 is separated from the lower surface 610*b*4 of the lower body 610*b* by springback action.

In addition, in a state where the deco cover 630 is fastened, the lower spray arm 61 is disposed at a position accessible to the hand of a user while being entirely exposed to the washing space 21.

Accordingly, the possibility that the other end 6322 of the fastening tab 632 separated from the lower surface 610*b*4 of the lower body 610*b* may cause injury to the hand of a user may not be ruled out.

As a way for preventing a user from being injured by the other end 6322 of the fastening tab 632, the lower spray arm 61 according to an embodiment of the present disclosure may include an accommodation portion forming rib 610*b*42 forming an accommodation portion 610*b*45 that may be stored in a state where the other end 6322 of the fastening tab 632 is bent.

Figure 31:
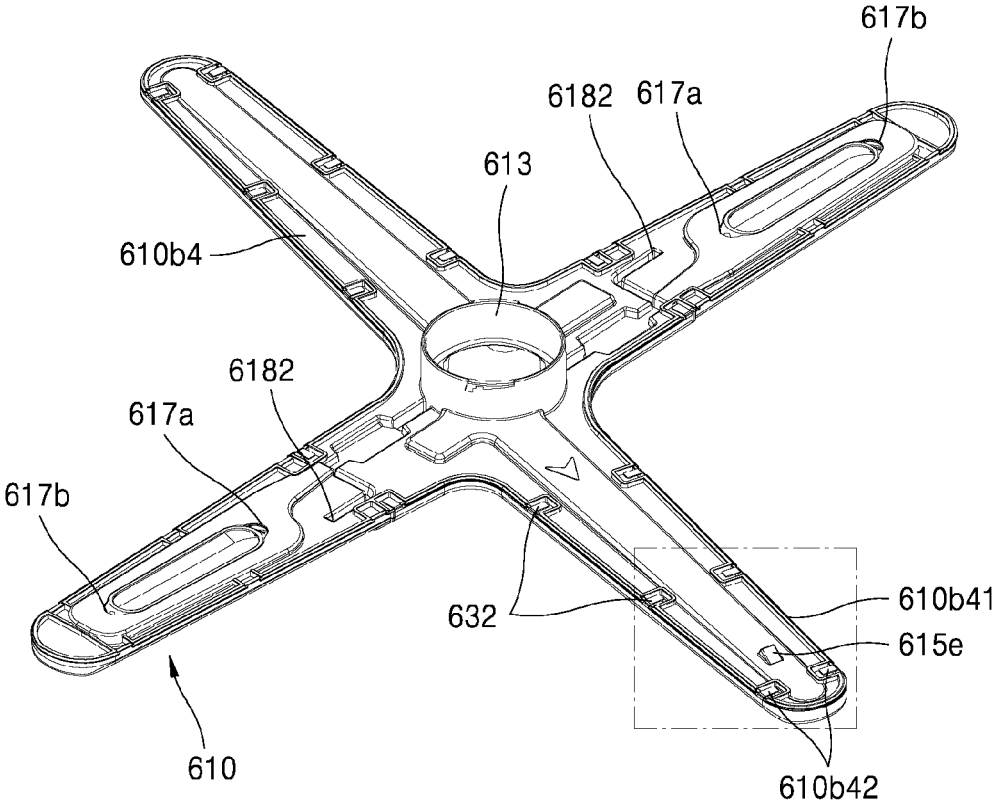
FIG. 31 is a bottom view of FIG. 30.
Figure 32:
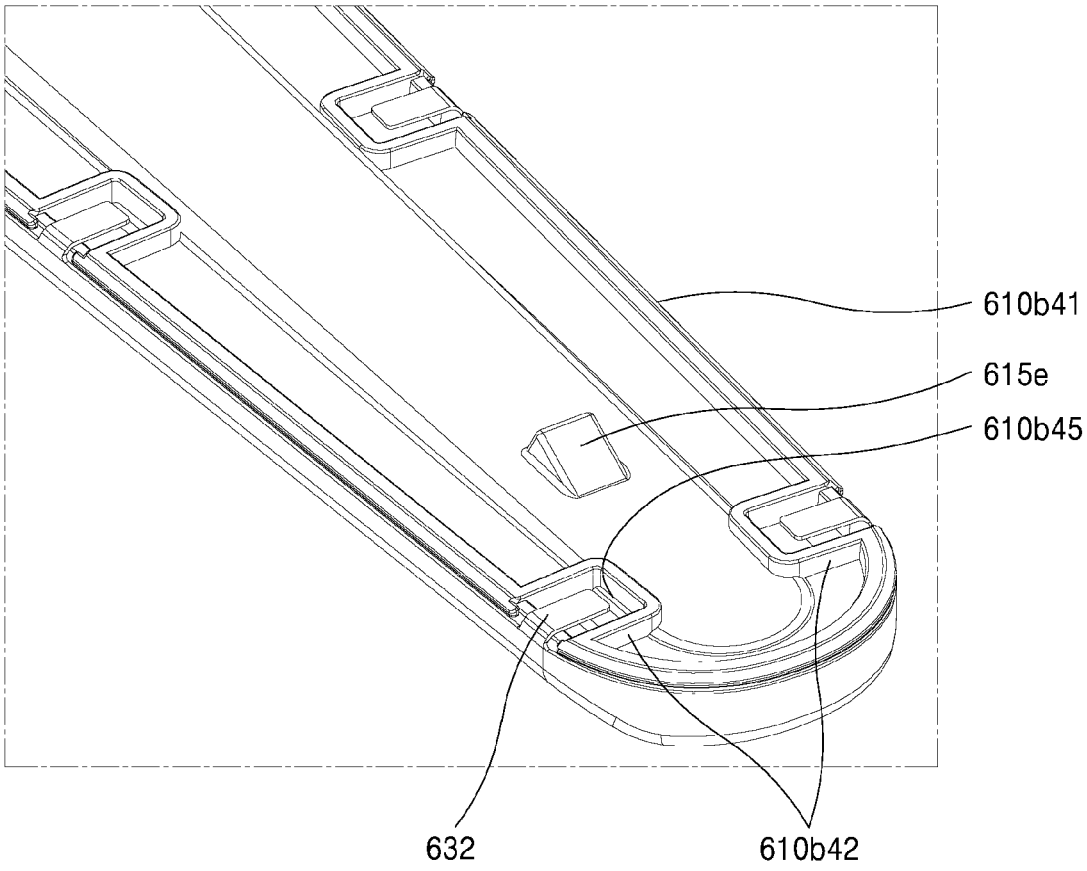
FIG. 32 is a partially enlarged view of FIG. 31.
Figure 33:
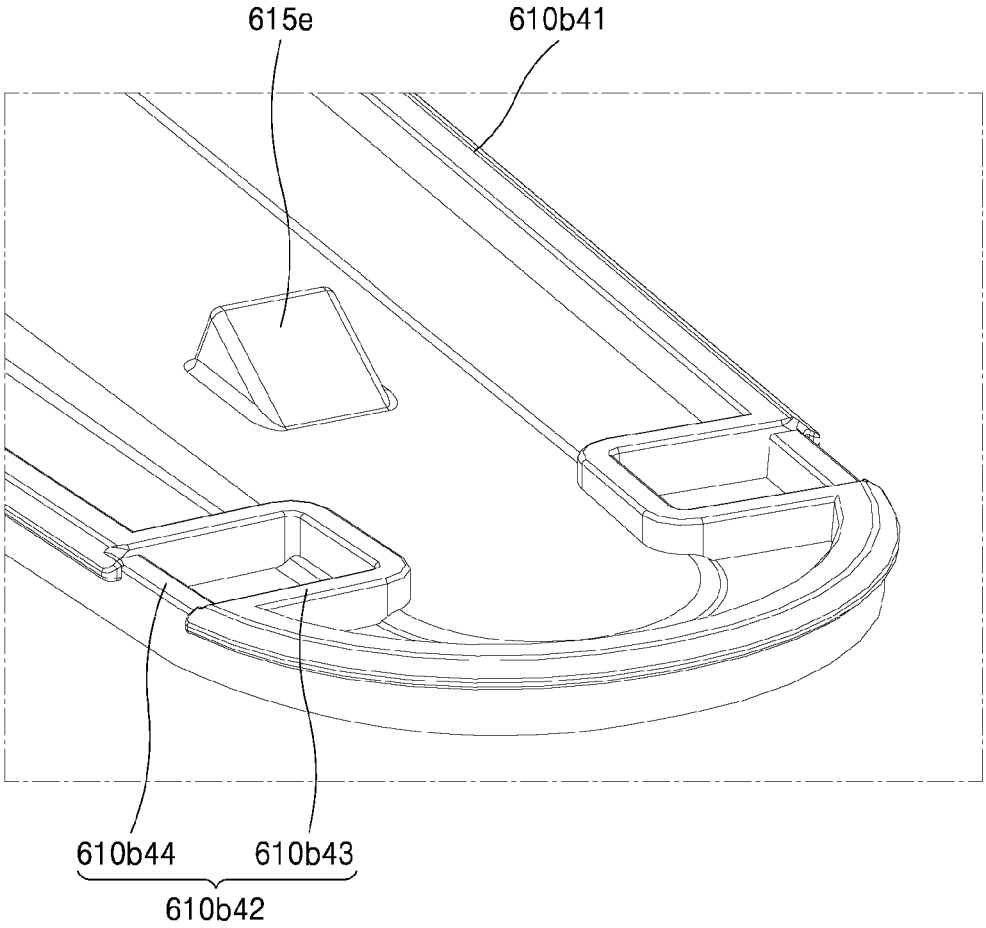
FIG. 33 is a partially enlarged view illustrating the bottom of the lower cover illustrated in FIG. 30.

As illustrated in FIGS. 31 to 33, the lower surface 610*b*4 of the lower body 610*b* of the lower spray arm 61 may be provided with a reinforcing rib 610*b*41 having a uniform thickness and extends along the outer edge of the lower surface 610*b*4 and protruding downward.

In this connection, the reinforcing rib 610*b*41 may be continuously formed along the outer edge of the lower surface 610*b*4 in a state of having a substantially uniform protruding height from the lower surface 610*b*4 of the lower body 610*b*.

The accommodation portion forming rib 610*b*42 serves to form the accommodation portion 610*b*45 whose lower surface is entirely open and becomes a box-shaped empty space.

In more detail, the accommodation portion forming rib 610*b*42 may include an inner rib 610*b*43 provided on an inner side of the outer edge of the lower surface 610*b*4 of the lower body 610*b*, and an outer rib 610*b*44 extending along the outer edge of the lower surface 610*b*4 of the lower body 610*b*.

The inner rib 610*b*43 may protrude from the lower surface 610*b*4 of the lower body 610*b*, and may have one end and the other end integrally connected to the reinforcing rib 610*b*41.

Similar to the reinforcing rib 610*b*41, the inner rib 610*b*43 may protrude from the lower surface 610*b*4 of the lower body 610*b* to have a substantially uniform protruding height. Preferably, the protruding height of the inner rib 610*b*43 and the protruding height of the reinforcing rib 610*b*41 may be formed to be the same.

The inner space surrounded by the inner rib 610*b*43 functions as the aforementioned accommodation portion 610*b*45. Accordingly, the inner rib 610*b*43 may have a shape corresponding to the shape of the outer edge of the other end 6322 side of the fastening tab 632 so as to surround the other end 6322 of the fastening tab 632 to be accommodated in the accommodating portion 610*b*45. FIGS. 31 to 33 exemplarily illustrate a configuration in which the inner rib 610*b*43 extends in a square C-shape corresponding to the edge shape of the other end 6322 side of the fastening tab 632, which is square. An embodiment of the present disclosure is not limited thereto, but exemplarily the inner rib 610*b*43 will be described based on a configuration extending in a square C-shape.

The outer rib 610*b*44 may be disposed between one end and the other end of the inner rib 610*b*43.

As illustrated in FIG. 33, the outer rib **610*b*44 may connect one end and the other end of the inner rib 610*b*43, but may be formed to extend along the outer edge of the lower surface 610*b*4 of the lower body 610*b***.

In other words, the outer rib **610*b*44 may form one continuous rib extending along the outer edge of the lower surface 610*b*4 of the lower body 610*b* together with the reinforcing rib 610*b*41**.

When the fastening tab 632 is bent, the outer rib **610*b*44 may serve to define a bending position of the fastening tab 632**.

The bending position of the fastening tab 632 may be formed at a position lower than the lower surface **610*b*4 of the lower body 610*b* by using the outer rib 610*b*44**.

Accordingly, even when the other end 6322 of the fastening tab 632 is separated from the lower surface **610*b*4 of the lower body 610*b* due to the springback action after the bending is completed, the other end 6322 of the fastening tab 632 may be maintained at a higher position than the lower end of the inner rib 610*b*43. Thus, a state in which the other end 6322 side of the fastening tab 632** is accommodated inside the accommodation portion may be effectively achieved.

In this connection, the protruding height of the outer rib **610*b*44 protruding from the lower surface 610*b*4 of the lower body 610*b* may be formed smaller than the protruding height of the reinforcing rib 610*b*41 and the protruding height of the inner rib 610*b*43**.

As such, when the protruding height of the outer rib **610*b*44 is formed smaller than the protruding height of the inner rib 610*b*43, a portion where the other end 6322 side of the fastening tab 632 protrudes downward from the lower end of the inner rib 610*b*43 may be minimized. Accordingly, the possibility of injury to a user due to exposure of the other end 6322 of the fastening tab 632** may be minimized.

To this end, the protruding height of the outer rib **610*b*44 may have a numerical value obtained by subtracting the thickness of the fastening tab 632 from the protruding height of the inner rib 610*b*43**.

The present disclosure has been mainly described with reference to the exemplary drawings hereinabove; however, the present disclosure is not limited to the embodiments and the drawings set forth herein and various modifications can be made by those skilled in the art within the scope of the technical idea of the present disclosure. In addition, even if working effects obtained based on the configurations of the present disclosure are not explicitly described, predictable effects thereof also have to be recognized based on the corresponding configurations.

| Description of Reference Numerals |
|---|
| 1: DISHWASHER |
| 10: CASE |
| 20: TUB |
| 30: DOOR |
| 40: DRIVING PORTION |
| 50: STORAGE PORTION |
| 60: SPRAY PORTION |
| 90: BASE |
| 610: MAIN BODY PORTION |
| 610A: UPPER BODY |
| 610B: LOWER BODY |
| 613: HUB |

What is claimed is:

1. A dishwasher comprising:

a tub that defines a washing space;

a sump disposed at a lower side of the tub and configured to store washing water; and a spray arm configured to discharge the washing water from the sump into the washing space, wherein the spray arm comprises a main body portion that defines (i) an opening configured to receive the washing water from the sump, (ii) a first flow path configured to carry the washing water, and (iii) a suction hole in fluid communication with the washing space, the spray arm being configured to discharge the washing water having passed through the first flow path into the washing space, wherein the first flow path comprises:

a connection flow path configured to guide the washing water introduced through the opening of the main body portion, a buffer flow path fluidly connected to the connection flow path, wherein a cross-sectional area of the buffer flow path is larger than a cross-sectional area of the connection flow path, an air suction flow path fluidly connected to the buffer flow path and configured to guide air introduced from the washing space through the suction hole, and a discharge flow path fluidly connected to the air suction flow path, the discharge flow path having a discharge hole configured to discharge the washing water having passed through the air suction flow path toward the washing space, and wherein the buffer flow path comprises:

an inlet configured to receive the washing water from the connection flow path, and an outlet configured to discharge the washing water in the buffer flow path to the air suction flow path.

2. The dishwasher of claim 1, wherein a center of the inlet is disposed higher than a center of the outlet in a vertical direction.

3. The dishwasher of claim 1, wherein the spray arm comprises an inner protrusion that is disposed inside the spray arm and protrudes toward the outlet to thereby define a position of the outlet.

4. The dishwasher of claim 1, wherein a cross-sectional area of the inlet and a cross-sectional area of the outlet are different from each other.

5. The dishwasher of claim 4, wherein the cross-sectional area of the outlet is larger than the cross-sectional area of the inlet.

6. The dishwasher of claim 1, wherein the buffer flow path comprises:

an expansion portion that is disposed adjacent to the connection flow path and expands the cross-sectional area of the buffer flow path along a flow direction of the washing water in the buffer flow path;

a retaining portion that is disposed downstream of the expansion portion and maintains the cross-sectional area of the buffer flow path along the flow direction of the washing water; and a contraction portion that is disposed downstream of the retaining portion and contracts the cross-sectional area of the buffer flow path along the flow direction of the washing water.

7. The dishwasher of claim 1, wherein the first flow path further comprises an air flow passage configured to supply the air introduced through the suction hole to the air suction flow path, the air flow passage comprising at least one bending portion configured to change a flow direction of the air in the air flow passage.

8. The dishwasher of claim 7, wherein the air flow passage is connected to the air suction flow path at a position that is closer to the discharge flow path than to the buffer flow path.

9. The dishwasher of claim 1, wherein the suction hole is defined at and passes through a lower surface of the main body portion.

10. The dishwasher of claim 1, further comprising a bubble discharge portion that is disposed at the spray arm and passes through at least a portion of the main body portion in a vertical direction, the bubble discharge portion defining a first discharge hole, and wherein the bubble discharge portion is coupled to the main body portion.

11. The dishwasher of claim 10, wherein the bubble discharge portion is coupled to the main body portion by insert injection molding.

12. The dishwasher of claim 11, wherein the bubble discharge portion comprises:

a wall portion that extends through the main body portion in the vertical direction, the wall portion defining the first discharge hole; and a flange portion that is connected to an outer side surface of the wall portion and protrudes in a direction away from the outer side surface of the wall portion, and wherein at least a portion of the flange portion is embedded in the main body portion.

13. The dishwasher of claim 12, wherein the main body portion further defines:

a lower end coupling hole that receives a lower end of the wall portion; and a pair of second discharge holes arranged around the lower end coupling hole.

14. The dishwasher of claim 10, wherein the main body portion further comprises:

an upper body that defines an upper portion of the spray arm disposed above a horizontal reference line; and a lower body that defines a lower portion of the spray arm disposed below the horizontal reference line, the lower body being coupled to a lower side of the upper body, wherein the upper body or the lower body comprises a flow path forming rib that protrudes in the vertical direction to thereby define a left side surface and a right side surface of the first flow path.

15. The dishwasher of claim 1, wherein the connection flow path, the buffer flow path, and the air suction flow path are arranged along and extend in a longitudinal direction of the main body portion of the spray arm, and wherein the inlet and the outlet of the buffer flow path face each other in the longitudinal direction.

16. A dishwasher comprising:

a tub that defines a washing space;

a sump disposed at a lower side of the tub and configured to store washing water;

a pump configured to supply the washing water stored in the sump to the washing space; and a spray arm configured to discharge the washing water into the washing space, the spray arm having a suction hole and a discharge hole that are in fluid communication with an outside of the spray arm, wherein the spray arm comprises:

a first blade that defines a spray flow path configured to carry the washing water therein, the first blade being configured to spray the washing water into the washing space, a second blade that defines a bubble generation flow path configured to generate bubbles therein, the second blade being configured to supply the washing water including the bubbles into the washing space, and a hub that defines a supply flow path configured to supply the washing water discharged from the pump to the spray flow path and the bubble generation flow path, wherein the bubble generation flow path comprises:

a connection flow path connected to the supply flow path, a buffer flow path connected to the connection flow path, wherein a cross-sectional area of the buffer flow path expands and then contracts as the buffer flow path extends in a direction away from the connection flow path, an air suction flow path connected to the buffer flow path and configured to receive air introduced through from the suction hole, and a discharge flow path connected to the air suction flow path, wherein a cross-sectional area of the discharge flow path expands as the discharge flow path extends in a direction away from the air suction flow path, the discharge flow path being configured to guide the washing water to be discharged to the outside of the spray arm through the discharge hole, wherein the buffer flow path comprises:

an inlet configured to receive the washing water from the connection flow path, and an outlet configured to discharge the washing water in the buffer flow path to the air suction flow path.

17. The dishwasher of claim 16, wherein the second blade defines an additional flow path configured to spray the washing water into the washing space.

18. The dishwasher of claim 17, wherein the additional flow path is disposed at a side surface of the buffer flow path.

19. The dishwasher of claim 17, wherein the first blade defines a spray nozzle configured to spray the washing water in the spray flow path into the washing space, the spray nozzle being defined at an upper surface of the first blade, and wherein the second blade defines an additional spray nozzle configured to spray the washing water in the additional flow path into the washing space, the additional spray nozzle being defined at an upper surface of the second blade.

20. The dishwasher of claim 19, wherein an interval between the additional spray nozzle of the second blade and a center of the spray arm is less than an interval between the spray nozzle of the first blade and the center of the spray arm.

* * * * *